US011220976B2

(12) United States Patent
Marmorini

(10) Patent No.: US 11,220,976 B2
(45) Date of Patent: Jan. 11, 2022

(54) METHOD TO CONTROL IN ANY POSSIBLE OPERATING POINT THE COMBUSTION OF A COMPRESSION IGNITION INTERNAL COMBUSTION ENGINE WITH REACTIVITY CONTROL THROUGH THE FUEL INJECTION TEMPERATURE

(71) Applicant: MARMOTORS S.R.L., Arezzo (IT)

(72) Inventor: Luca Marmorini, Arezzo (IT)

(73) Assignee: MARMOTORS S.R.L., Arezzo (IT)

( * ) Notice: Subject to any disclaimer, the term of this patent is extended or adjusted under 35 U.S.C. 154(b) by 0 days.

(21) Appl. No.: 16/763,778

(22) PCT Filed: Nov. 16, 2018

(86) PCT No.: PCT/IB2018/059046
§ 371 (c)(1),
(2) Date: May 13, 2020

(87) PCT Pub. No.: WO2019/097472
PCT Pub. Date: May 23, 2019

(65) Prior Publication Data

US 2021/0172396 A1 Jun. 10, 2021

(30) Foreign Application Priority Data

Nov. 16, 2017 (IT) ..... 102017000131052

(51) Int. Cl.
*F02D 19/08* (2006.01)
*F02D 41/30* (2006.01)
(Continued)

(52) U.S. Cl.
CPC ..... *F02D 41/402* (2013.01); *F02B 1/12* (2013.01); *F02D 19/081* (2013.01);
(Continued)

(58) Field of Classification Search
CPC .. F02D 19/081; F02D 41/3047; F02D 41/402; F02D 41/403; F02D 2200/0606;
(Continued)

(56) References Cited

U.S. PATENT DOCUMENTS 5,163,397 A * 11/1992 Pien ..... F02M 43/02 123/299
6,227,151 B1 * 5/2001 Ma ..... F02D 19/081 123/3

(Continued)

FOREIGN PATENT DOCUMENTS

WO WO 2013/112169 8/2013
WO WO 2017/009799 1/2017

*Primary Examiner* — Erick R Solis
(74) *Attorney, Agent, or Firm* — Leason Ellis LLP

(57) ABSTRACT

A method to control the combustion of a compression ignition engine having the steps of: establishing, for each combustion cycle, a fuel quantity to be injected into the cylinder; injecting a first fraction of the fuel quantity; heating a second fraction of the fuel quantity, which is equal to the remaining fraction of the fuel quantity, to an injection temperature higher than 100° C.; injecting the second fraction of the fuel quantity heated to the injection temperature into the cylinder at the end of the compression stroke and at no more than 60° from the top dead centre; and decreasing the injection temperature and the ratio between the second fraction and the first fraction as the internal combustion engine increases and as the rotation speed of the internal combustion engine increases.

28 Claims, 7 Drawing Sheets

(51) Int. Cl.

| | |
|---|---|
| ***F02M 31/12*** | (2006.01) |
| ***F02M 31/16*** | (2006.01) |
| ***F02M 53/06*** | (2006.01) |
| ***F02D 41/40*** | (2006.01) |
| ***F02B 1/12*** | (2006.01) |
| ***F02M 31/18*** | (2006.01) |
| ***F02M 43/00*** | (2006.01) |
| *F02D 41/38* | (2006.01) |

(52) U.S. Cl.
CPC ..... *F02D 41/403* (2013.01); *F02M 31/16* (2013.01); *F02M 31/183* (2013.01); *F02M 43/00* (2013.01); *F02D 41/3047* (2013.01); *F02D 2041/389* (2013.01); *F02D 2200/0606* (2013.01); *F02M 53/06* (2013.01)

(58) Field of Classification Search
CPC ..... F02M 31/16; F02M 31/18; F02M 31/183; F02M 31/125; F02M 43/00; F02M 53/06
USPC ..... 123/299, 300, 304, 557, 558
See application file for complete search history.

(56) References Cited

U.S. PATENT DOCUMENTS

| | | | | |
|---|---|---|---|---|
| 6,378,489 | B1 * | 4/2002 | Stanglmaier | F02D 19/0649 123/304 |
| 8,616,178 | B2 | 12/2013 | Palumbo | |
| 8,991,358 | B2 | 3/2015 | Gehrke | |
| 9,151,241 | B2 | 10/2015 | Gehrke et al. | |
| 2011/0057049 | A1 | 3/2011 | Hofbauer et al. | |
| 2011/0209686 | A1 * | 9/2011 | McCann | F02M 53/06 123/304 |
| 2013/0081592 | A1 | 4/2013 | Boer et al. | |
| 2013/0104543 | A1 | 5/2013 | Zoldak et al. | |
| 2014/0026859 | A1 | 1/2014 | Gehrke | |
| 2014/0251278 | A1 | 9/2014 | De Boer et al. | |

* cited by examiner

METHOD TO CONTROL IN ANY POSSIBLE OPERATING POINT THE COMBUSTION OF A COMPRESSION IGNITION INTERNAL COMBUSTION ENGINE WITH REACTIVITY CONTROL THROUGH THE FUEL INJECTION TEMPERATURE

CROSS-REFERENCE TO RELATED APPLICATIONS

This patent application is a U.S. National Phase Application under 35 U.S.C. § 371 of International Patent Application No. PCT/IB2018/059046, filed on Nov. 16, 2018, which claims priority from Italian patent application no. 102017000131052 filed on Nov. 16, 2017, all of which are incorporated by reference, as if expressly set forth in their respective entireties herein.

TECHNICAL FIELD

The present invention relates to a method to control in any possible operating point the combustion of a compression ignition internal combustion engine with reactivity control by means of the fuel injection temperature.

PRIOR ART

International regulations concerning the containment of emissions of polluting gases produced by motor-vehicles envisage a gradual reduction in emissions that can be released into the atmosphere in the coming years (particularly a significant reduction in $NO_x$ and particulate matter).

Due to the increasingly stringent regulations, exhaust gas treatment systems have become increasingly expensive and complex and furthermore it is not guaranteed that in the future said regulations can be respected considering the current state of development of internal combustion engines and of exhaust after-treatment systems.

In particular, in compression ignition internal combustion engines (operating according to the Diesel cycle and using mainly diesel fuel) the emissions are critical for the particulate matter generated as a consequence of the high concentration gradient between air and injected fuel and $NO_x$ generated in areas of the combustion chamber with high temperatures. Currently, the fuel used in compression ignition internal combustion engines has an octane number (RON) less than 30 and a cetane number higher than 45.

The use of spark ignition engines (operating according to the Otto cycle and using mainly gasoline fuel) could simplify the problem of polluting gas emissions; however, the efficiency of this type of internal combustion engine (even in the most modern versions) is lower than that of compression ignition internal combustion engines. Typically, the efficiency of spark ignition internal combustion engines is less than 34%.

The creation of homogeneous charge combustion could help to solve the problem of particulate matter emissions. The reduction of $NO_x$ could, however, be addressed by using low temperature combustion that can be achieved by using very lean mixtures with respect to the stoichiometric conditions and by using an exhaust gas recirculation system (EGR).

The fuels used (such as gasoline and diesel fuel) have different self-ignition characteristics. Diesel fuel can self-ignite easily (i.e. it has a high reactivity) and has optimal characteristics at low load and at low temperatures. Gasoline, on the other hand, is more difficult to self-ignite (i.e. it has a low reactivity) and its characteristics are preferable for high load and high temperatures.

The use of homogeneous mixtures of air and fuel with a high number of cetane (high reactivity, such as diesel fuel) does not allow to reach high compression ratios and consequently high yields. This is one of the reasons why in compression ignition internal combustion, very high pressure injection systems (close to 2000 bar) and strategies of very complex multiple injections have been developed, so as to be able to inject near the top dead centre and to not incur in the problem of detonation.

On the other hand, high octane fuels (such as gasoline and generally all fuels with high percentages of bio-components) would allow high compression ratios even for premixed air and fuel mixtures.

In general, compression ignition engines with a homogeneous charge (called Homogeneous Charge Compression Ignition—HCCI) have shown strong potential in terms of efficiency and emissions, due to the homogeneity of the charge and the conditions of low combustion temperature.

Compression ignition internal combustion engines with a high degree of premixing (i.e. HCCI or Premixed Charge Compression Ignition—PCCI) offer very interesting characteristics regarding emissions and efficiency of the internal combustion engine, but in practice these strategies are generally limited in the field of use under various load conditions. This is due to the lack of adequate control of the combustion timing and to the difficulty to control the pressure gradient during combustion.

Compression ignition combustion systems controlled by the reactivity of fuels (Reactivity Controlled Compression Ignition—RCCI) have shown very interesting results in terms of efficiency and emissions and better control of combustion timing. Said compression ignition combustion systems controlled by the reactivity of fuels are for example described in U.S. Pat. No. 8,616,177B2, US20140026859A1, U.S. Pat. Nos. 8,991,358B2 and 9,151,241B2.

The RCCI system typically uses a premix of air with low reactivity fuel (e.g. gasoline) and a subsequent direct injection of highly reactive fuel as a combustion activator (e.g. diesel fuel or gasoline with a cetane activator). These systems showed both numerically and experimentally an indicated efficiency close to 50% in low load applications and very low emission levels under medium load conditions of the internal combustion engine.

In terms of control strategies, the critical operating conditions for RCCI-type internal combustion engines are low and high engine load conditions. In fact, under medium load conditions (i.e. with a mean pressure of, for example, 9 bar) the control showed a high efficiency with an acceptable pressure gradient, whereas under low load conditions (i.e. with a mean pressure equal to, for example, 2 bar) the excessive delay of ignition of the premixed gasoline leads to high combustion times.

In tests on internal combustion engines for heavy commercial vehicles, the RCCI strategy showed near-zero particulate matter and $NO_x$ emissions and an expected yield close to 55%. On the other hand, compression ignition internal combustion engines of the conventional type instead reach efficiency of about 48% in similar conditions, but with particulate matter and $NO_x$ emissions greater than one order of magnitude. The improvement obtained is in the first instance a consequence of the reduction of losses due to heat exchange resulting from a lower combustion temperature, avoiding regions with a concentration of fuel close to stoichiometric combustion and keeping the high temperature volumes away from the surfaces by means of an appropriate configuration of the piston crown.

Technical solutions based on the injection of two different fuels are also known, for example from EP2682588A1, which however require two independent injection systems in the vehicle. This not only entails greater complexity and a higher cost of the fuel supplying system, but also has the disadvantage of having to supply two different fuels at the same time in two separate tanks.

Several scientific articles, such as the article written by Kokjohn and Kavuri and published in the scientific journal "International Journal of Engine Research"—IJER of 2015, have clearly highlighted that the RCCI system can extend its operative field by means of an additional direct injection of low reactivity fuel. Under low load conditions, numerical optimization strategies have led to a significant increase in the indicated efficiency and combustion efficiency by means of direct gasoline injection. The resulting stratification of concentration before the stratification of reactivity leads to a complete combustion. However, the direct injection timing is extremely critical and must be carefully controlled to avoid regions where the air-fuel equivalence ratio ($\phi$) is greater than 0.5 which would favour $NO_x$ formation. At high load (for example at the indicated mean pressure of 20 bar) the pressure gradient is excessive due to the lack of ignition delay difference between the premixed fuel and the fuel injected by direct injection. By setting the limit of the pressure gradient during combustion equal to 10 bar per engine degree, the maximum achievable load is in good linear approximation with the increase in the recirculation of the exhaust gases obtained by an EGR system.

The scientific publication of Wissnik and Reitz published in the scientific journal SAE international (SAE 2015-01-0856), has illustrated very promising results using a post injection of low reactivity fuel, thus obtaining a sort of union between the RCCI system and other compression of gasoline ignition concepts.

To improve efficiency, it is also known to use a concentration stratification for controlling the development of combustion with the partially premixed combustion system (Partially Premixed Combustion—PCCI). However, the use of high octane fuel is a limitation of these strategies, as it requires extremely high levels of injection pressure (greater than 1000 bar). Said systems have not yet been developed for spark ignition internal combustion engines. The low viscosity of gasoline makes their development much more critical compared to the systems that have been developed for diesel fuel. The possibility of resorting to lower pressures is linked to the use of fuels with a lower octane number. Various studies, in the field, have illustrated that a fuel with an octane number of 70 could be the ideal fuel for this type of combustion control, but said fuels are not currently available in the worldwide distribution network. Therefore, these types of fuel would require a serious impact in the fuel production strategy. It should also be added that said aspect goes against the addition of any bio-component to the fuel, since it generally leads to an increase in the octane number of the fuel itself.

Various proposals have also been made, known for example from US2014251278A1 and US2013081592A1, based on the use of preheated fuel, using gasoline instead of diesel fuel, and maintaining the advantage of the efficiency typical of compression ignition internal combustion engines. The use of a single heated fuel system shows advantages in terms of miscibility between air and fuel and a reduction in self-ignition time. Supercritical injection was seen as an effective means for improving mixing time without having to resort to high injection pressures, as described for example in US2011057049A1. The reduction of the self-ignition time is essential to control the onset of combustion, but if applied to the first injection (which makes up the majority of the injected fuel) the latter must be injected during the intake and compression stroke so as to obtain a sufficient homogeneity of the mixture. Injecting hot fuel during these steps can lead to an incipient charge detonation and the consequent need to reduce the compression ratio of the internal combustion engine and consequently the efficiency thereof. However, moving most of the injection close to the top dead centre causes the problem of increasing emissions of polluting gases. This occurs in a very similar way to injection systems of compression ignition internal combustion engines due to the presence of high concentration gradients in the combustion chamber leading to the formation of particulate matter and $NO_x$. This problem can be solved partially under high load conditions with high recirculation percentages of exhaust gas and high injection pressures (above 500 bar).

It is clear that the stratification of reactivity and concentration can be controlled by controlling the injection temperature. As described in US2013081592A1, using higher injection temperatures results in better miscibility and consequently better homogeneity of the mixture. On the other hand, in cases where greater concentration stratification is needed (for example at low load), there is a need to increase reactivity to achieve combustion stability (therefore high injection temperatures). As a consequence it is important to independently control both the concentration stratification and the reactivity stratification in order to be able to extend the field of use of the engine and this is not possible with the injection temperature only, unless an injector can be considered that can vary the injection temperature and its pressure in the various injections within an engine cycle.

The most critical problem of known systems based on hot fuel injection, however, lies in the demand for energy for heating. The hot injection of the total fuel quantity in the field of 350-500° C. can represent from 15% to 27% of the total energy of the fuel injected, considering the lower calorific value of a commercial fuel. This makes the system extremely inefficient from an energy point of view unless complex regeneration systems are used to transfer energy from exhaust gases to fuel. In addition to the complexity of said systems, the low load and cold start conditions would be difficult to solve.

In summary, the known combustion control systems show low indicated yields, with a consequent increase in $CO_2$ and $NO_x$ emissions, which will prove that the international regulations concerning the emissions of polluting gases will no longer be satisfactory in the future. Considering also that the heavy commercial transport sector will require an increasing quantity of diesel fuel in the future, it is necessary to try to increase the use of gasoline as fuel even in the commercial and heavy transport sector.

Furthermore, it is important to improve internal combustion engines, in order to be able to use a higher percentage of bio-components both for automotive applications and for light and heavy commercial transport.

Patent application WO2017009799A1 describes a method to control the combustion of a compression ignition internal combustion engine; the internal combustion engine is provided with at least one piston which slides, with reciprocating motion, inside a cylinder so as to carry out a succession of combustion cycles, each comprising at least one intake stroke and one compression stroke. The control method comprises the steps of:

establishing, for each combustion cycle, a fuel quantity to be injected into the cylinder;

injecting a first fraction of the fuel quantity at least partially during the intake and/or compression stroke by means of a first fuel injector which receives the fuel from a first supplying system without active heating devices so that the first fraction of the fuel quantity present an "environment" temperature;

heating a second fraction of the fuel quantity, equal to the remaining fraction of the fuel quantity, to an injection temperature of over 100° C. (and thus far exceeding the "environment" temperature); and injecting the second fraction of the fuel quantity heated at the injection temperature into the cylinder at the end of the compression stroke and preferably no more than 60° from the top dead centre by means of a second fuel injector which is different from and independent of the first fuel injector, directly injects into the cylinder, and receives fuel from a second supplying system which is separate from and independent of the first supplying system and is provided with at least one active heating device which is controlled so as to allow the fuel to reach the injection temperature.

The method to control the combustion described in the patent application WO2017009799A1 allows, at the same time, to obtain a high energy efficiency and a reduced production of pollutants (particularly of particulate matter and NOR) while maintaining a relatively simple internal combustion engine structure.

The method to control the combustion described in patent application WO2017009799A1 represents an improvement with respect to what has been presented in the patents proposed to date, as it offers in detail a solution that allows the same engine configuration to cover the entire operating range. However, the aforementioned patent application does not provide specific values of the control variables and solutions relating to the control system adapted to maintain high energy efficiency and a reduced production of pollutants at all the possible rotation speeds of the internal combustion engine and to all the possible loads of the internal combustion engine. In other words, the method to control the combustion described in patent application WO2017009799A1 provides indications or proposals for obtaining energy efficiency and a reduced production of pollutants at a given engine point (i.e. at a given rotation speed and at a given load), but it does not propose solutions able to obtain, from the internal combustion engine, a high energy efficiency and a reduced production of pollutants in any possible engine points.

The patent application WO2013112169A1 describes an internal combustion engine in which two different fuels (with low reactivity and high reactivity) are injected; in particular, a first injector indirectly injects into the intake manifold gasoline or natural gas while another injector directly injects the diesel fuel into the combustion chamber.

DESCRIPTION OF THE INVENTION

The object of the present invention is, therefore, to provide a method to control in any possible operating point the combustion of a compression ignition internal combustion engine with reactivity control by means of the fuel injection temperature which is free of the drawbacks of the state of the art and that it is easy and inexpensive to implement.

According to the present invention is provided a method to control in any possible operating point the combustion of a compression ignition internal combustion engine with reactivity control through the fuel injection temperature according to what is claimed in the attached claims.

The present invention is based on the experimental evidence that the fuel injected into a mixture of air and fuel at high temperature and pressure can reduce its self-ignition time depending on the temperature of the fuel injected. A higher temperature reduces the initial heat exchange of the jet and anticipates the start of the phase controlled by the chemical kinetics.

Increasing the temperature and pressure of the mixture can reduce the self-ignition time more efficiently, but it goes against the fact that a clear advantage in terms of emissions can be obtained if the end-of-compression temperature is kept low to reduce the temperature during combustion and consequently $NO_x$ formation.

BRIEF DESCRIPTION OF THE DRAWINGS

The present invention will now be described with reference to the accompanying drawings, which illustrate a non-limiting example of embodiment, wherein.

PREFERRED EMBODIMENTS OF THE INVENTION

Figure 1:
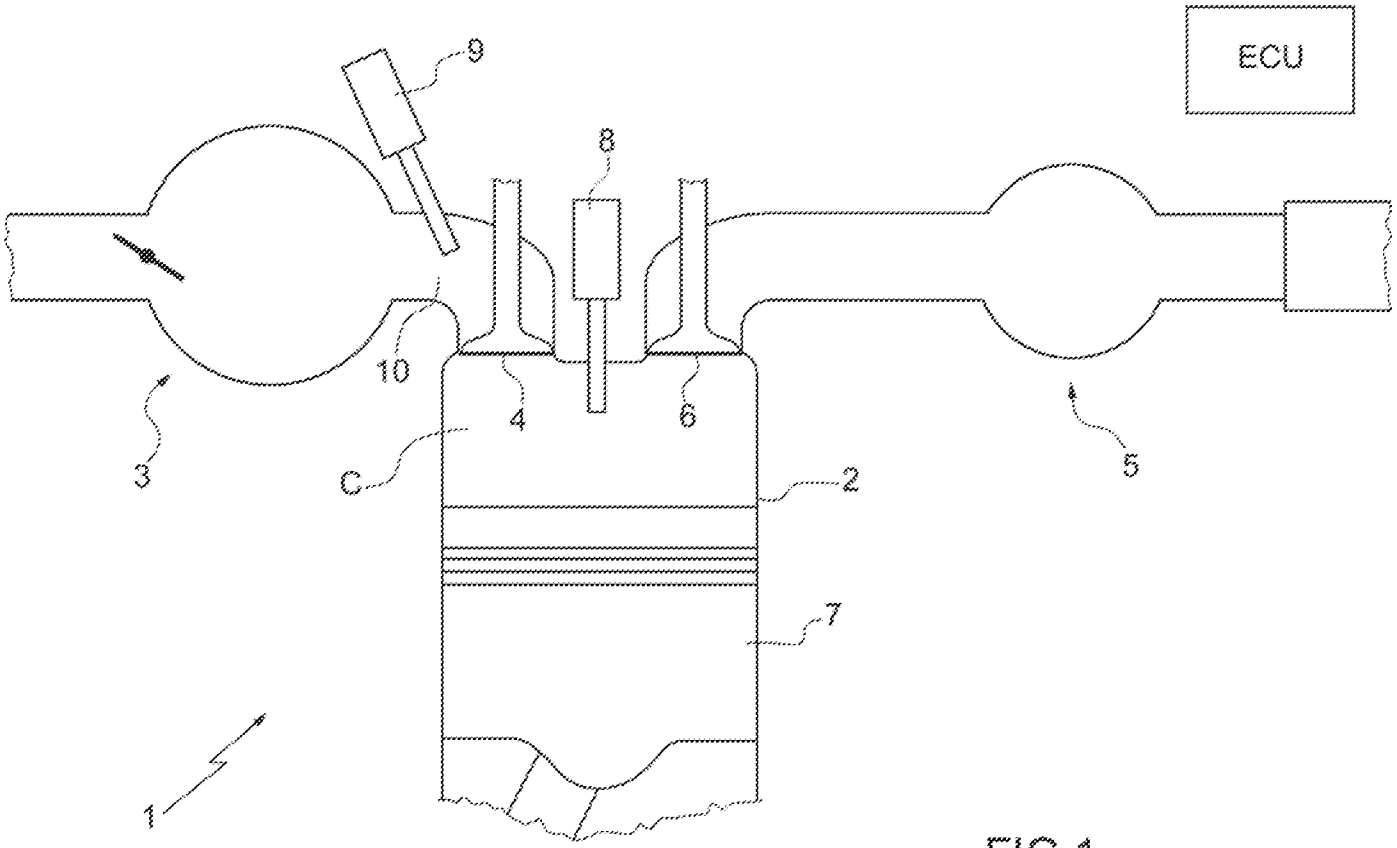
FIGS. 1-4 are schematic views of different embodiments of an internal combustion engine.

In FIG. 1, number 1 denotes as a whole an internal combustion engine which uses gasoline as fuel and is provided with a cycle having at least an intake stroke and a compression stroke.

In the following disclosure explicit reference will be made, without thereby losing any generality, to the case in which the internal combustion engine 1 is a four-stroke internal combustion engine 1; obviously the method to control the combustion is also applicable to a two-stroke internal combustion engine 1.

In the preferred embodiment, the internal combustion engine 1 is supercharged, but it could also be a naturally-aspirated internal combustion engine 1.

The internal combustion engine 1 could also be provided with an EGR system for recirculating the exhaust gases during the intake stroke, as will be better described in the following.

The internal combustion engine 1, illustrated in FIGS. 1-4, is a four-stroke internal combustion engine 1 provided with a plurality of cylinders 2 (only one of which is illustrated in FIG. 1), each of which is connected to an intake manifold 3 via at least one intake valve 4 and to an exhaust manifold 5 via at least one exhaust valve 6.

In the following disclosure explicit reference will be made, without thereby losing any generality, to the case in which the compression stroke and the expansion stroke are carried out by means of the reciprocating motion of a piston 7.

As is known, fuels are characterized by two indicators, the cetane number and the octane number, which can be considered inversely proportional in first approximation. The cetane number is an indicator of behavior during the ignition of the fuel; in other words, the cetane number expresses the readiness of the fuel for self-ignition, where, the greater the cetane number is, the greater the readiness will be. The cetane number is calculated experimentally by detecting the delay between the injection and ignition steps, by assigning to the cetane ($C_{16}H_{34}$) a value equal to 100 and to methylnaphthene a value equal to 0 (or by assigning a value of 15 to the isocetan). The so-called cetane index is similar to the cetane number, which is calculated taking into account the density and volatility of the fuel and which is close, in first approximation, to the cetane number. The octane number expresses the anti-detonation characteristic of the fuel, i.e. it expresses the resistance to self-ignition. Diesel fuel has a high reactivity (high cetane number and low octane number), whereas gasoline has a low reactivity (high octane number and low cetane number).

Inside each cylinder 2 the corresponding piston 7 is arranged, which is adapted to perform a reciprocating motion inside the cylinder 2 between a top dead centre PMS and a bottom dead centre PMI. The top dead centre PMS is arranged at the head of the cylinder 2 inside which the piston 7 moves; in particular, the top dead centre PMS is at the point where the piston 7 is closest to the head i.e. at the lower volume point of a combustion chamber C formed between the crown of the piston 7 and the head of the internal combustion engine 1. Whereas, the bottom dead centre PMI is arranged at the minimum distance of the piston 7 from the base of the internal combustion engine 1, i.e. it is the point corresponding to the maximum stroke of the piston 7.

In the preferred embodiment illustrated in FIGS. 1-4, the internal combustion engine 1 is a four-stroke type and the piston 7 slides, with a reciprocating motion, on the inside the cylinder 2 so as to carry out a succession of combustion cycles, each comprising an intake stroke, a compression stroke, an expansion stroke and a discharge stroke.

Figure 2:
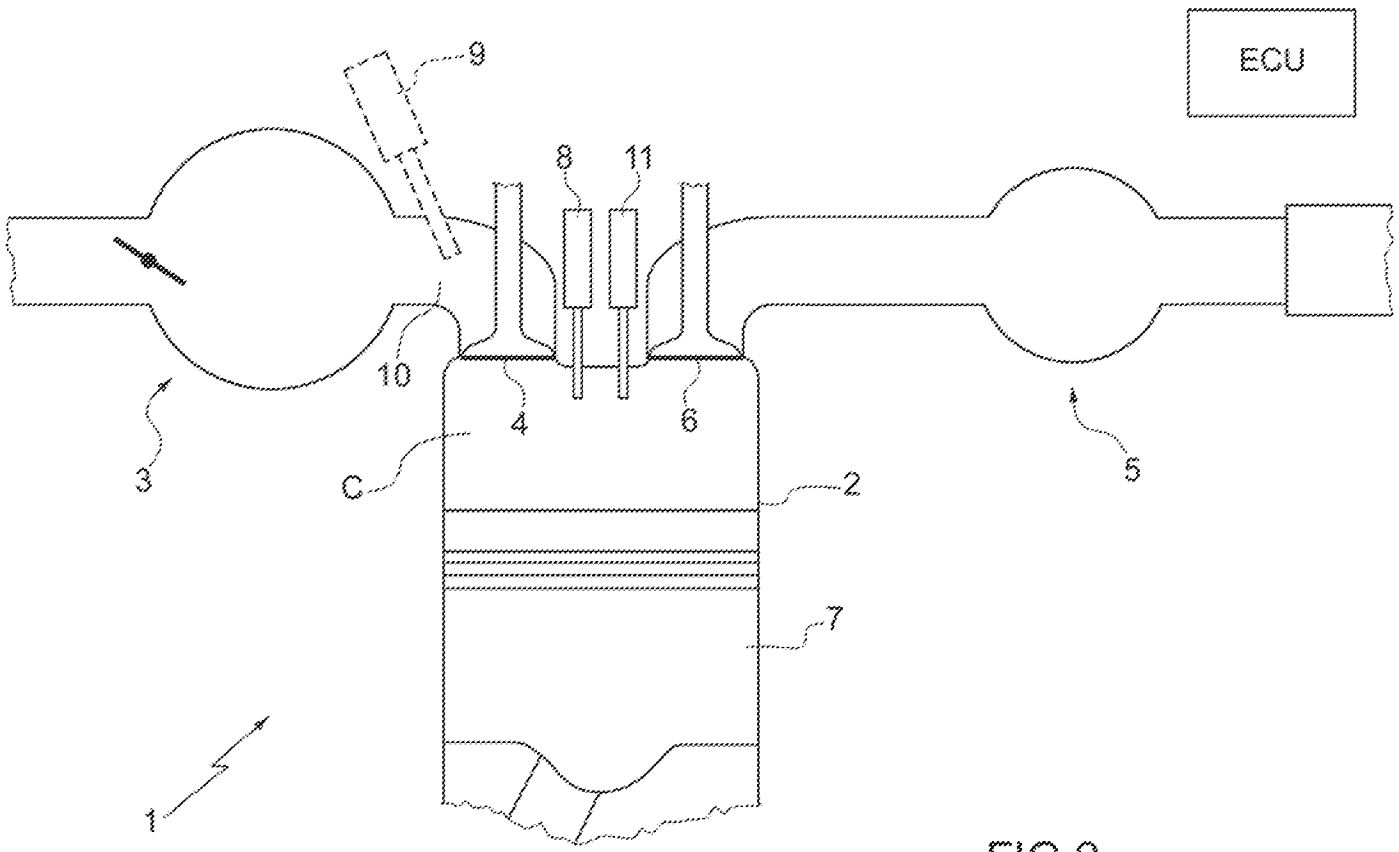
Figure 3:
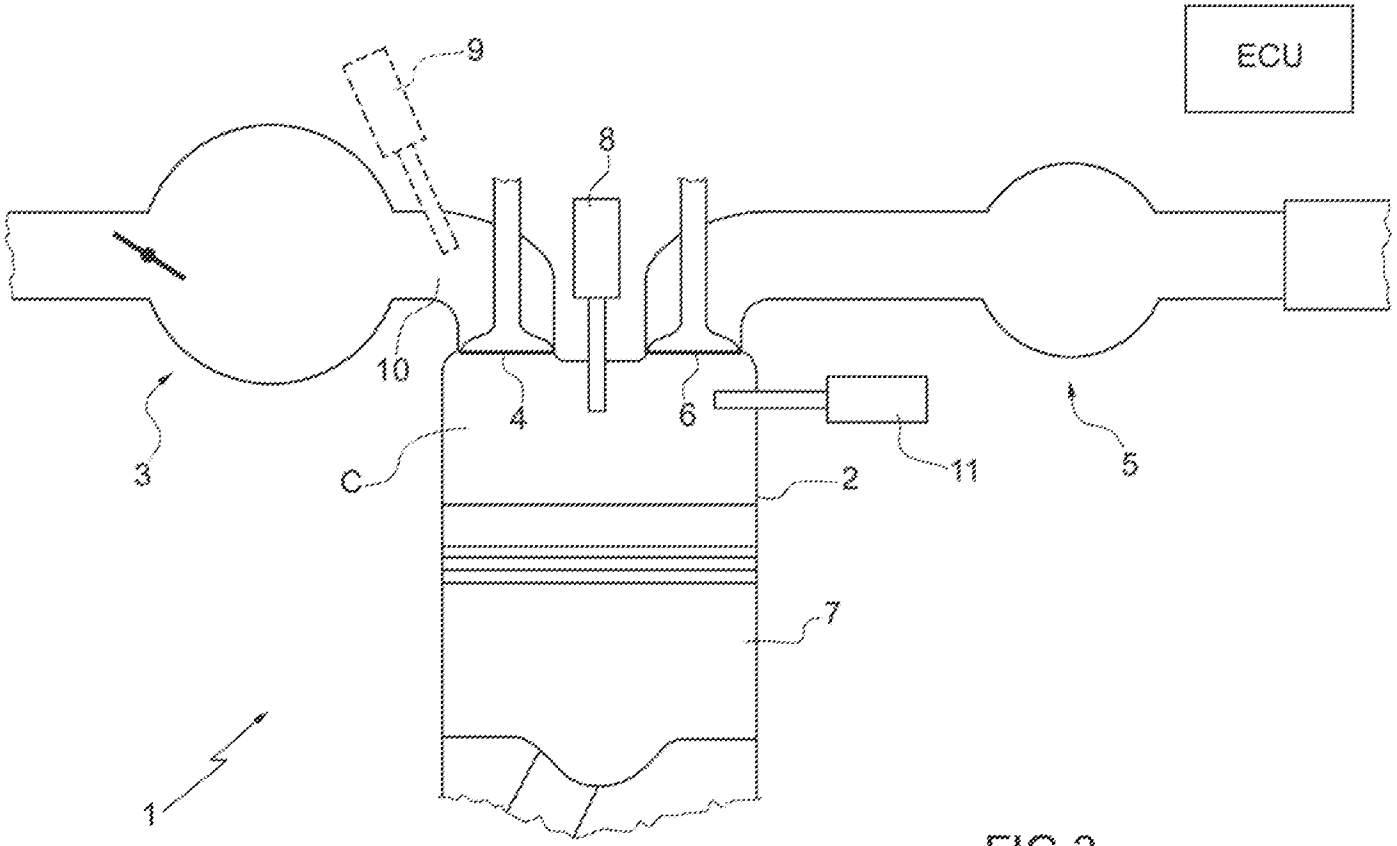

The internal combustion engine 1 is provided with: an electronic control unit ECU, a detonation detection system, a pressure sensing system in the combustion chamber C, a fuel injector 8 for direct injection (FIG. 1-4), a fuel injector 9 for indirect injection (FIGS. 1 and 4), and/or an additional fuel injector 11 for direct injection (FIGS. 2 and 3). The fuel injector 8 and the fuel injector 11, if provided, are adapted to directly inject the fuel into the cylinder 2; whereas, the fuel injector 9, if provided, is adapted to inject the fuel outside of the cylinder 2, that is, to an intake duct 10, as will be better described in the following.

The electronic control unit ECU is adapted to control the fuel injection by adjusting (varying) from time to time a fuel quantity Q to be injected, by adjusting (varying) from time to time the number of fractionations every time (that is, if performing a single injection or two or more subsequent injections), and by adjusting (varying) the injection instants (i.e. the injection anticipation) from time to time. For each combustion cycle, the electronic control unit ECU establishes the fuel quantity Q to be injected during the combustion cycle itself and fractionation thereof. In particular, as will be better described in the following, the fuel quantity Q is divided into a fraction F1 of the fuel quantity Q and into a fraction F2 of the fuel quantity Q, which are complementary to each other (i.e. the sum of the two fractions F1 and F2 is equal to the fuel quantity Q).

The detonation detection system acquires data regarding the detonation in real time. In particular, data coming from a specific sensor will be processed (for example a pressure sensor in the combustion chamber C or an accelerometer arranged at the head of the internal combustion engine 1), so as to modify the injection parameters.

If the conditions are such as to detect a detonation (incipient or marked) or if the pressure gradient in the combustion chamber C is higher than the defined limit values as a function of the load conditions, the electronic control unit ECU will correct the injection step or the percentage of the fraction F2 of the fuel quantity Q according to a priority sequence to avoid detonation or to obtain acceptable pressure gradients. Typically there will be a change in the injection anticipation and a change in the fraction F2 of the fuel quantity Q to be injected. Eventually, the electronic control unit ECU could also correct the injection step of the fraction F1 of the fuel quantity Q.

When critical combustion conditions are no longer detected, the injection will return to the map values. This system allows to avoid breakage related to heavy detonations (perhaps due to local overheating) or to create a map offset to avoid damage related to slight, but continuous, detonation phenomena (for example due to gasoline with different characteristics).

The pressure detection system is adapted to acquire and control the pressure gradient during combustion, in order to avoid noise and mechanical damage to the components; the pressure gradient is kept within defined values by adjusting the injection parameters by means of the electronic control unit ECU.

The fuel injector 8 is adapted to inject the fuel that subsequently will be combusted directly in the combustion chamber C formed between the crown of the piston 7 and the head of the internal combustion engine 1. The injection is divided into two separate injections of the fractions F1 and F2 of the fuel quantity Q, which are carried out by the fuel injector 8 and by the fuel injector 9 and/or by the fuel injector 11, as will be better described in the following.

The first injection of the fraction F1 of the fuel quantity Q is at least partially carried out during the intake and/or compression stroke. In particular, the first injection of the fraction F1 of the fuel quantity Q could be partially carried out even during the beginning of the compression stroke. Whereas the second injection of the fraction F2 of the remaining fuel quantity Q is carried out at the end of the compression stroke (at no more than 60° from the top dead centre PMS). The first injection of the fraction F1 of the fuel quantity Q is carried out entirely during the intake stroke or partly during the intake stroke and, for the remaining part, during the beginning of the compression stroke (indicatively within 60°-100° from the bottom dead centre PMI, i.e. no more than 60° from the top dead centre PMS). Under high-load conditions of the internal combustion engine 1, part of the fraction F1 of the fuel quantity Q could be injected after the top dead centre and subsequently to the injection of the fraction F2 of the fuel quantity Q. Instead, the second injection of the fraction F2 of the fuel quantity Q (which is complementary to the fraction F1 to obtain the fuel quantity Q) is carried out at the end of the compression stroke typically no more than 60° from the top dead centre PMS.

In other words, initially (i.e. during the intake stroke and/or during the beginning of the compression stroke) the fraction F1 of the fuel quantity Q is injected, which is equal to at least 60% of the fuel quantity Q, preferably ranging between 70% and 95% of the fuel quantity Q; whereas, towards the end of the compression stroke, that is, just before the top dead centre PMS (no more than 60° from the top dead centre PMS) the injection of the remaining fraction F2 of the fuel quantity Q that is at most 30% of the fuel quantity Q is injected directly inside the cylinder 2.

The injection type of the fractions F1 and/or F2 of the fuel quantity Q can be a single injection or a multiple injection. In other words, the injection of the fraction F1 of the fuel quantity Q can take place by means of only one opening (single opening) of the fuel injector 9 and/or of the fuel injector 11 or by means of several consecutive openings (multiple injection) of the fuel injector 9 and/or of the fuel injector 11; i.e. the injection of the fraction F1 of the fuel quantity Q can be subdivided into several parts which take place at successive and close instants. Similarly, the injection of the fraction F2 of the fuel quantity Q can take place by means of only one (single opening) of the fuel injector 8 or by means of several consecutive openings (multiple injection) of the fuel injector 8; that is, the injection of the fraction F2 of the fuel quantity Q can be subdivided into several parts which take place at successive and close instants. In the case of multiple injection of the fraction F2 of the fuel quantity Q, the first injection can take place before 60° from the top dead centre PMS. Typically, the first injection of the fraction F2 of the fuel quantity Q takes place at no more than 90° from the top dead centre PMS and the last injection of the fraction F2 of the fuel quantity Q takes place not before 60° from the top dead centre PMS.

The two fractions F1 and F2 of the fuel quantity Q are injected at two different temperatures.

In particular, the fraction F1 of the fuel quantity Q is injected by a supplying system which is free of active heating devices, as will be better described in the following, and therefore at "environment" temperature. In this way the fraction F1 of the fuel quantity Q has a temperature lower than an injection temperature T (above 100° C. and preferably ranging between 100° C. and 600° C.)

Whereas, the fraction F2 of the fuel quantity Q is injected by a supplying system that is provided with active heating devices, as will be better described in the following. The supplying system of the fraction F2 of the fuel quantity Q is separated from and independent of the supplying system of the fraction F1 of the fuel quantity Q. The fraction F2 of the fuel quantity Q is previously heated at the injection temperature T and consequently the fraction F2 of the fuel quantity Q is injected at the injection temperature T. The injection temperature T is above 100° C. and preferably ranges between 100° C. and 600° C.; the injection temperature T can reach 600° C. when fuels with high percentages of bio-components are used. The electronic control unit ECU establishes (normally by means of appropriate, experimentally proven maps) the fractioning of the fuel quantity Q to be injected into the cylinder 2 (i.e. the ratio between the two fractions F1 and F2 of the fuel quantity Q, for example 75%/25% or 83%/17%, or 92%/8%) depending on the load condition and establishing (normally by means of appropriate, experimentally proven maps) also the injection temperature T of the fraction F2 of the fuel quantity Q (i.e. the injection temperature T at which the fuel of the fraction F2 of the fuel quantity Q is heated before being injected) based on the load condition. In particular, the electronic control unit ECU establishes, depending on the load condition, the ratio between the two fractions F1 and F2 of the fuel quantity Q, the instants in which to carry out the injections (i.e. the injection anticipations), and the injection temperature T to which the fraction F2 of the fuel quantity Q is to be heated before being injected.

In general, the ratio between the two fractions F1 and F2 of the fuel quantity Q and the instants in which to carry out the injections (i.e. the injection anticipations) are established based on different variables, such as the rotation speed of the internal combustion engine 1, the load condition, the injection temperature T, the air intake temperature, and the level of supercharging (of course only in the presence of supercharging of the internal combustion engine 1).

The electronic control unit ECU of the internal combustion engine 1 comprises a control system which is preferably of closed-loop type and which is configured to define the variables listed above. A possible control strategy for the control system determines the variables listed above according to an input variable, taking into account the operating variables of the internal combustion engine 1, and through a series of feedback variables it determines the value of a variable output.

Typically, the input variable is at least one variable selected, for example, from among: the torque required for the internal combustion engine 1 and the operating point (load and rotation speed) of the internal combustion engine 1. The evaluation of the load condition of the internal combustion engine 1 is performed in consideration of the indicated mean pressure (i.e. the load condition of the internal combustion engine 1 coincides with the indicated mean pressure of the internal combustion engine 1). The indicated mean pressure is expressed as the ratio between the work indicated per cycle of the internal combustion engine 1 and the cylinder capacity of the internal combustion engine 1. For example, a low load can be defined when the indicated mean pressure is less than 4 bar, medium load when the indicated mean pressure ranges from 4 to 11 bar and high load when the indicated mean pressure is above 11 bar.

The operating variable of the internal combustion engine 1 can, on the other hand, be at least one variable selected from among: the air temperature, at input, of the internal combustion engine 1, the cooling liquid temperature of the internal combustion engine 1, the lubrication oil temperature of the internal combustion engine 1, the exhaust gas temperature, the revolutions per minute of the internal combustion engine 1, the exhaust gas temperature for the recirculation downstream of a heat exchanger in the presence of the exhaust gas recirculation system EGR, the plenum pressure of the intake manifold 3, the fuel temperature in a common rail, the position of the timing variation devices and/or of a variable lift system. In the case of supercharged engines in addition to the above-mentioned operating variables, is also the exhaust gas pressure upstream of the turbine, the turbocharger revolutions per minute, the exhaust gas temperature upstream of the turbine, the position of the turbocharger regulators in case of variable geometry of the compressor and of the turbine. The output variable, on the other hand, is at least one variable selected from among: the injection temperature T, the fuel quantity Q, the ratio between the fraction F2 of the fuel quantity Q and the fraction F1 of the fuel quantity Q, the angular distance from the top dead centre PMS of the beginning of the injection of the fraction F1 and of the fraction F2, the type of injection (i.e. if the injection is single or multiple) of the fractions F1 and F2 of the fuel quantity Q, the exhaust gas recirculation percentage in the presence of the exhaust gas recirculation system EGR, the actual compression ratio (having timing variation devices and/or the variable lift system), the turbocharger geometric characteristics (having variable geometry of the supercharging system), and the supercharging pressure. Finally, the feedback variable is at least one variable selected from among: the maximum combustion pressure, the angular position corresponding to a percentage, preferably 50%, of the burned fuel quantity Q, and the pressure gradient during the fuel combustion in the combustion chamber C.

Therefore, the control system (i.e. the electronic control unit ECU) determines the injection temperature T and/or the ratio between the fraction F2 of the fuel quantity Q and the fraction F1 of the fuel quantity Q and/or the angular distance from the top dead centre PMS of the beginning of the injection of the fraction F2 of the fuel quantity Q and/or the type of injection sequences of the injections of the fractions F1 and F2 of the fuel quantity Q as the load and/or the rotation speed of the internal combustion engine 1 are varying and of the operating conditions; while, as previously described, the operating conditions can comprise, for example: the air intake temperature, the supercharging level (in the event of a supercharging), the exhaust gases recirculation percentage (in the presence of the exhaust gas recirculation system EGR), the positioning of the timing variation devices, the cooling liquid temperature of the internal combustion engine 1. Typically, the injection temperature T and/or the ratio between the fraction F2 of the fuel quantity Q and the fraction F1 of the fuel quantity Q and/or the angular distance from the top dead centre PMS of the beginning of the injection of the fraction F2 of the fuel quantity Q decreases as the load and/or rotation speed of the internal combustion engine 1 increases.

In particular, the control system (i.e. the electronic control unit ECU) varies the injection temperature T as a function of the load of the internal combustion engine 1 and according to the rotation speed of the internal combustion engine (1) between a maximum injection temperature $T_{MAX}$ (for example equal to 500° C.) and a minimum injection temperature $T_{min}$ (for example equal to 250° C.) clearly lower than the maximum injection temperature $T_{MAX}$.

In the case where gasoline is used as fuel, it has been seen that when the internal combustion engine 1 works with a low load (i.e. when the indicated mean pressure is below 4 bar), in order to achieve the highest efficiency, the injection temperature T must be greater than 450° C., preferably 500° C., and/or the fraction F2 of the fuel quantity Q must comprise at least 70% of the fuel quantity Q. If the reactivity of the injected fuel is too low, the fraction F2 of the fuel quantity Q can temporarily reach even 100% of the fuel quantity Q in order to obtain the highest efficiency. Advantageously, the possibility of increasing the injection temperature T, allows to decrease the percentage of the fraction F2 of the fuel quantity Q.

Moreover, at low load, the temperature of the air inside the cylinder 2 upon closing the intake valve 4 (i.e. the air sucked in by the cylinder 2) can be increased, for example to 70° C., by adjusting the operation of an intercooler when provided (in supercharged engines the intercooler cools the air leaving the turbocharger before the same enters the internal combustion engine 1 and therefore allows the air intake temperature to be controlled within given limits) or by varying the percentage of EGR (the exhaust gases are hot and therefore, by increasing/decreasing the percentage of exhaust gases, the temperature of the air inside the cylinder 2 (i.e. the air sucked in by the cylinder 2) increases/decreases. Alternatively or in addition, the temperature of the air inside the cylinder 2 (i.e. the air sucked in by the cylinder 2) at the closing of the intake valve 4 can be increased by varying the closing stroke of the intake valve 4. Finally, the temperature of the air inside the cylinder 2 (i.e. the air sucked in by the cylinder 2), upon closing of the intake valve 4, can be increased by directly injecting at least a part of the fraction F1 of the fuel quantity Q during the intake stroke and/or during the compression stroke and at no more than 60° from the top dead centre PMS. In other words, when the internal combustion engine 1 works with a low load, in particular when the indicated mean pressure is below 4 bar, the air inside the cylinder 2 is heated when the intake valve 4 is closed, i.e. the air sucked in by the cylinder 2, at a temperature equal to 70° C. or even above 70° C.

When the internal combustion engine 1 works with a low load, in particular when the indicated mean pressure is below 4 bar, and when the temperature of the air on the inside of the cylinder 2 upon closing the intake valve 4 (i.e. the temperature of the air sucked in by the cylinder 2) is equal to 70°, the fraction F2 of the fuel quantity Q can also be reduced to 60% of the fuel quantity Q (without the heating of the air inside the cylinder 2 upon closing the intake valve 4, the fraction F2 of the fuel quantity Q cannot fall below 70%).

When the internal combustion engine 1 works with a low load, in particular when the indicated mean pressure is below 4 bar, exhaust gas recirculation is normally not used (i.e. exhaust gas recirculation is zero).

When the internal combustion engine 1 works with a medium load (i.e. when the indicated mean pressure ranges from 4 to 11 bar), in order to achieve the highest efficiency, the injection temperature T must range between 350° C. and 500° C., and/or the fraction F2 of the fuel quantity Q must range between 5% and 25% of the fuel quantity Q. It should be taken into account that the higher yields are obtained with high injection temperatures T (i.e. an injection temperature T near 500° C. and the fraction F1 of the fuel quantity Q higher than 90%). In order to optimize the efficiency of the internal combustion engine 1 and at the same time reduce the polluting emissions, it is also necessary to consider exhaust gas recirculation percentages which typically are, at medium load, of the order of 0%-25% (i.e. no exhaust gas recirculation up to a maximum of 25% of exhaust gas recirculation). Moreover, at medium load the temperature of the intake air preferably ranges between 40° C. and 70° C.

Whereas, when the internal combustion engine 1 works with a high load (for example with a mean pressure above 11 bar), in order to reach the highest efficiency, the injection temperature T must range between 200° C. and 300° C. and/or the fraction F2 of the fuel quantity Q must range between 3% and 10% of the fuel quantity Q. Furthermore, at high load the recirculation percentage of the exhaust gases ranges between 0% and 30% (i.e. no exhaust gas recirculation up to a maximum of 25% of exhaust gas recirculation). Finally, at high load at least a part of the fraction F1 of the fuel quantity Q can be injected, preferably by the injector 11 which performs a direct injection, at no more than 60° from the top dead centre PMS.

At high load of the internal combustion engine 1 the reactivity of the fuel injected with the fraction F2 of the fuel quantity Q must be decreased to avoid excessively high pressure gradients and excessive pressures in combustion chamber C. The possibility of decreasing the injection temperature T has the advantage of being able to decrease the reactivity of the fuel injected during the injection of the fraction F2 of the fuel quantity Q. If at high load the reactivity of the fuel cannot be sufficiently decreased, it is necessary to anticipate the injection of the fraction F2 of the fuel quantity Q.

In particular, when the internal combustion engine 1 works with a low load (i.e. the indicated mean pressure is less than 4 bar) the angular distance from the top dead centre PMS of the beginning of the injection of the fraction F2 must normally be higher than 45°. On the other hand, when the internal combustion engine 1 works with a medium load (i.e. when the actual mean pressure ranges from 4 to 11 bar) the angular distance from the top dead centre PMS of the beginning of the injection of the fraction F2 must range between 30° and 60°. By further increasing the load, i.e. when the internal combustion engine 1 works with a high load and therefore the indicated mean pressure is above 11 bar, the angular distance from the top dead centre PMS of the beginning of the injection of the fraction F2 can be less than 60°. A delay in ignition can result in more $NO_X$ emission. To reduce the combustion temperature, the possibility of using exhaust gas recirculation in a percentage variable from 10% to 40% must be considered.

In the case where the fraction F2 of the fuel quantity Q is injected by multiple injections, the above applies. However, the first injection should take place, for example, at 90° from the top dead centre PMS, whereas the final injection must take place at no more than 60° from the top dead centre PMS.

As previously explained, in the case of a low-load, in general, an additional variable, influencing the control of the internal combustion engine 1, is the temperature that the intake air has upstream of the intake valve 4. In particular, by increasing the temperature of the intake air, the fraction F2 of the fuel quantity Q could be reduced, with a direct advantage in terms of efficiency of the internal combustion engine 1.

The temperature of the air upon closing the intake valve 4 can be varied by varying the percentage of the exhaust gas recirculation, but above all by varying the compression ratio of the internal combustion engine 1. A variation of the closing angle of the intake valve 4 allows to optimize the air temperature upon closing of the intake valve 4 and the actual compression ratio of the internal combustion engine 1.

The fraction F1 of the fuel quantity Q is injected without any heating (i.e. it is not necessary that the fuel injected into the fraction F1 of the fuel quantity Q has a particular temperature). However, due to the compression at which the fraction F1 of the fuel quantity Q is subjected before injection, there is an involuntary heating (in any case at temperatures lower than the injection temperature T which is reached only by a suitable heating). In fact, as is known from thermodynamics, a fluid subjected to compression heats up due to the work done by friction and of the work necessary for varying the volume of the fluid itself during its compression. In other words, the heating of the fraction F1 of the fuel quantity Q is not achieved by the aid of an active heating device. For example, for gasoline, the temperature reached by the fraction F1 of the fuel quantity Q is usually well below 100° C.

The fraction F2 of the fuel quantity Q, instead, must be previously heated to the injection temperature T in general ranging between 100° and about 520° C. before being injected. Said range of the injection temperature T reasonably comprises all possible fuels that could be used, whereas for gasoline only the injection temperature T normally ranges between 150° and 520° C.

By using fuels with high percentages of bio-components, the injection temperature T can even reach 600° C., in order to achieve the highest combustion yields.

In any case, the precise value of the injection temperature T is set by the electronic control unit ECU both (and predominantly) according to the fuel used, and according to the work conditions as previously described.

By heating the fraction F2 of the fuel quantity Q there is an increase in its reactivity, which is equivalent to injecting a fuel with a higher number of cetane. For example, gasoline has a cetane number lower than 30 at environment temperature; whereas heating the gasoline gives the fraction F2 of the fuel quantity Q a greater equivalent reactivity, comparable to the diesel fuel. In other words, by increasing the temperature of the fraction F2 of the fuel quantity Q, i.e. by heating the same, it is possible to increase the reactivity of the fraction F2 of the fuel quantity Q itself. As an effect of heating the fraction F2 of the fuel quantity Q in addition to the increase in reactivity, there is also the variation of the diffusivity of the fraction F2 of the fuel quantity Q; in other words, the injection temperature T has an important effect also in mixing with the air which is qualitatively similar to the effect of the injection pressure. The injection pressure, given a certain injection temperature T, is used to achieve the required air-fuel mixture in terms of jet penetration and shape.

From a management and control point of view of the internal combustion engine 1, the division of the injection of the fuel quantity Q into a first injection of the fraction F1 of the fuel quantity Q and a second injection of the fraction F2 of the fuel quantity Q, implies that the fraction F1 of the fuel quantity Q (preferably equal to at least 70%) makes a lean mixture (that is, low in fuel) and basically homogeneous inside the combustion chamber C. In this way, the injection of the fraction F2 of the fuel quantity Q achieves a stratification of both fuel concentration and reactivity within the combustion chamber C.

The injection of the fraction F1 of the fuel quantity Q together with the intake air and the possible exhaust gas recirculation produces a lean mixture (i.e. low in fuel) and ensures that no problem of detonation occurs, i.e. of the fuel self-ignition, during compression even in the presence of a high compression ratio (for example ranging between 15 and 20).

The injection of the fraction F2 of the heated fuel quantity Q at the end of the compression stroke, and in particular at not more than 60° from the top dead centre PMS, has a reactivity and a diffusivity such that the injection can be carried out without the aid of high injection pressures (injection pressure can be less than 500 bar). Beyond that, the fraction F2 of the fuel quantity Q is heated at the injection temperature T, typically ranging between 100° and 520° C., and injected at a short distance from the top dead centre PMS; in this way, the fraction F2 of the fuel quantity Q is in controlled self-ignition conditions, due to the delay reduction and repeatability of the fuel ignition. Therefore, in the internal combustion engines 1 to which the aforesaid control method is applied, the aid of a spark plug which activates combustion by means of the electrodes is optional since the fraction F2 of the fuel quantity Q, which has been previously heated at the injection temperature T, has a high reactivity (high cetane number) and is therefore able to self-ignite, causing the subsequent combustion of all the fuel found in the combustion chamber C (i.e. it causes a diffuse flame start which leads to self-ignition conditions also the fraction F1 of the fuel quantity Q). The internal combustion engine 1 is therefore also capable of operating without an ignition spark plug, which, however, could also be adapted to be used in particular conditions, for example when the internal combustion engine 1 is cold-started and/or idling and/or to possibly increase combustion stability during low load transitional phase.

Moreover, the internal combustion engine 1 is able to operate even without a throttle valve arranged at the intake manifold 3 to choke the flow of the intake air. This would reduce pumping losses and would increase the efficiency of the internal combustion engine 1 at partial load. According to an embodiment which is not the subject of the present invention, both injections of the fractions F1 and F2 of the fuel quantity Q are carried out by the fuel injector 8 arranged centrally with respect to the combustion chamber C. In this way both the fractions F1 and F2 of the fuel quantity Q (at different times established by the control unit ECU) are injected directly into the combustion chamber C by the same fuel injector 8. In other words, the two fractions F1 and F2 of the fuel quantity Q are injected directly into the combustion chamber C from the only fuel injector 8 which flows into the cylinder 2 and which heats the fractions F1 and F2 of the fuel quantity Q and injects the same at two different time points. The injection of the fraction F1 of the fuel quantity Q can take place at least partially during the intake stroke of the internal combustion engine 1, whereas the injection of the fraction F2 of the fuel quantity Q takes place at short distance from the end of the compression stroke of the internal combustion engine 1. This solution could be interesting if it were possible to have different injection temperatures T inside the injections of the same engine cycle. Said aspect is technically very critical as the thermal inertia of the fuel injector 8 is high. If, on the other hand, the injection was to take place with the same temperature for both the fractions F1 and F2 of the fuel quantity Q, important disadvantages would arise. The hot injection of the fraction F1 of the fuel quantity Q would reduce the detonation resistance of the mixture with consequent need to reduce the compression ratio of the internal combustion engine 1 and therefore the efficiency of the same. The logical consequence would be to increase the fraction F2 of the fuel quantity Q, but this would entail a greater criticality of the pressure gradient in combustion chamber C and of the maximum combustion temperature with a consequent increase in particulate matter and $NO_x$ emissions and a reduction in the engine efficiency. However, the greatest criticality lies in the fact that heating the entire injected fuel quantity Q at temperatures higher than 300° C. requires an energy contribution of over 15% of the energy content of the injected fuel (considering a lower calorific value of 42 MJ/kg). This is very critical in terms of efficiency and obliges to resort to complex exhaust gas recirculation systems EGR that recover energy from the exhaust gases and which are in any case ineffective in conditions of cold start and low engine load.

According to the embodiment illustrated in FIG. 1, the injections of the fractions F1 and F2 of the fuel quantity Q are carried out by the two separate fuel injectors 8 and 9. In particular, the injection of the fraction F1 of the fuel quantity Q (preferably at least 70% of the fuel quantity Q, preferably ranges between 80% and 95% of the fuel quantity Q) is carried out by the fuel injector 9 which is arranged upstream of the intake valve 4 (at the intake duct 10). The injection of the fraction F2 of the fuel quantity Q instead takes place through the fuel injector 8 which is arranged centrally with respect to the combustion chamber C and flows into the same. In other words, the two fractions F1 and F2 of the fuel quantity Q are injected at two different positions into the internal combustion engine 1. The fraction F1 of the fuel quantity Q is injected into the intake duct 10 by the fuel injector 9 so as to form a mixture with the air, while the fraction F2 of the fuel quantity Q is injected directly into the combustion chamber C by the fuel injector 8 arranged centrally with respect to the combustion chamber C. In this way a stratification of the concentration and reactivity of the charge contained in the combustion chamber C of the internal combustion engine 1 is obtained. Regarding the injection pressures, the fuel injector 8 injects the fuel at a much higher pressure, typically at least 5 times higher than the injection pressure of the fuel injector 9. For example, the injection pressure of the fuel injector 8 could range between 200 and 500 bar and the injection pressure of the fuel injector 9 could ranges between 5 and 50 bar.

According to other embodiments, illustrated in FIGS. 2 and 3, the fraction F1 of the fuel quantity Q is at least partially injected directly into the cylinder 2 by the fuel injector 11. In other words, the fuel injector 11 flows directly inside the cylinder 2, so as to at least partially inject the fraction F1 of the fuel quantity Q. Therefore, the two fractions F1 and F2 of the fuel quantity Q are injected separately by two separate fuel injectors 8 and 11 which both perform the direct injection into the cylinder 2.

According to a further embodiment, in addition to the injectors 8 and 11, the injector 9 (indicated with a broken line in FIG. 2) can also be provided, which performs the indirect fuel injection. In this case, the injection of an initial part of the fraction F1 of the fuel quantity Q is carried out by the fuel injector 9 which is arranged upstream of the intake valve 4 during the intake stroke. Subsequently, during the compression stroke, the fraction F2 of the fuel quantity Q is injected by means of the fuel injector 8. The remaining part of the fraction F1 of the fuel quantity Q can be injected by the injector 11 mainly during the compression stroke and before the injection of the fraction F2 of the fuel quantity Q. Alternatively, the remaining part of the fraction F1 of the fuel quantity Q can be mainly injected before the injection of the fraction F2 of the fuel quantity Q and partly after the injection of the fraction F2 of the fuel quantity Q. In this way, the stratification of the charge contained in the combustion chamber C of the internal combustion engine 1 is obtained both in terms of concentration and reactivity which is effective in high load conditions.

It should be underlined that, if the initial part of the fraction F1 of the fuel quantity Q were injected at the beginning of the compression stroke and in closed valve condition, said part of the fraction F1 of the fuel quantity Q would be necessarily injected by the fuel injector 11, which flows directly into the cylinder 2, and not by the fuel injector 9.

As illustrated in FIGS. 2 and 3, the fuel injector 11 can be arranged at different positions with respect to the cylinder 2. In particular, as illustrated in FIG. 2, the fuel injector 11 can be arranged beside the fuel injector 8. In other words, the fuel injector 8 and the fuel injector 11 are arranged beside each other and both flow into the crown of the cylinder 2. That is, the fuel injector 8 and the fuel injector 11 inject centrally into the combustion chamber C.

Alternatively, as illustrated in FIG. 3, the fuel injector 11 can flow laterally into the combustion chamber C (i.e. through a side wall of the cylinder 2). That is, the fuel injector 11 flows into the combustion chamber C, at a lateral position. In particular, the fuel injector 11 can inject both at the side of the exhaust valve 6 and at the side of the intake valve 4 of the internal combustion engine 1.

As previously described only the fraction F2 of the fuel quantity Q must be heated at the injection temperature T by an active heating device 12 before being injected. In other words, the fraction F2 of the fuel quantity Q must be heated at the injection temperature T, so as to increase its reactivity. While, the fraction F1 of the fuel quantity Q is not heated by the heating device 12.

Figure 5:
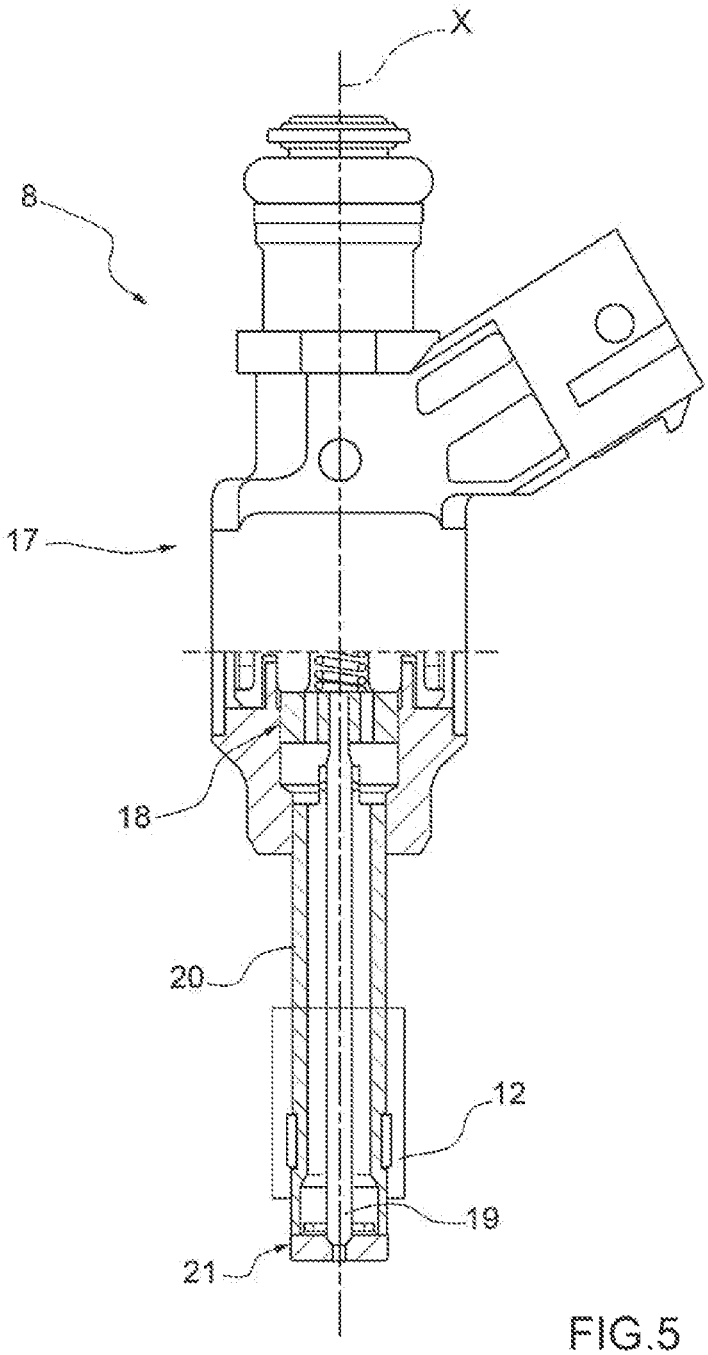
FIG. 5 is a schematic and partially sectioned view of an injector of the internal combustion engine of FIGS. 1-4.

According to a possible embodiment, the fraction F2 of the fuel quantity Q can be heated by the heating device 12 coupled to the fuel injector 8, as illustrated in FIG. 5, and as described hereinafter.

According to a different embodiment, in addition to the fuel injector 8, the fuel injector 11 can also be provided with its own heating device (different and separate from the heating device 12). Whereas, if provided, the fuel injector 9, which indirectly supplies the fraction F1 of the fuel quantity Q, is always without a heating device. Part of the fraction F1 of the injected fuel quantity Q can be heated at a lower temperature (different) than the injection temperature T of the fraction F2 of the fuel quantity Q so as to obtain a better stratification of the concentration and reactivity of the charge.

According to what has been described previously, under normal conditions the fuel injector 11 will not inject preheated fuel and its main effect will be to stratify the concentration ensuring a progressive self-fuel ignition of the fuel charge contained in the combustion chamber C.

Said injector 11 can help to stabilize the combustion under low load conditions and consequently to reduce the fraction F2 of the fuel quantity Q.

Figure 4:
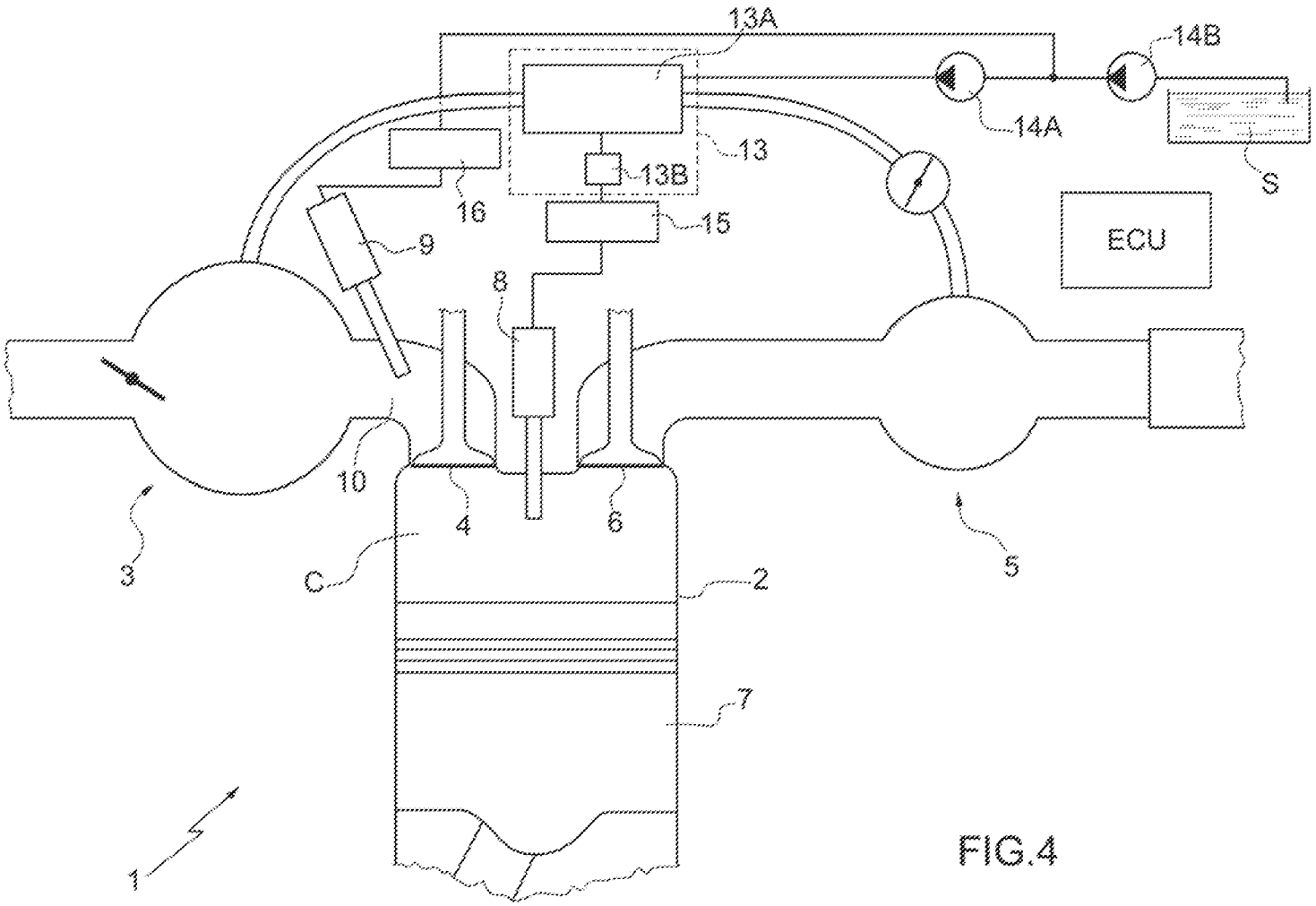

According to a different embodiment illustrated in FIG. 4, the fraction F2 of the fuel quantity Q can be heated by an active heating device 13 which is arranged upstream of the fuel injector 8 and downstream of a high pressure fuel pump 14A which in turn is arranged downstream of a low pressure fuel pump 14B which draws the fuel from a tank S.

According to the embodiment illustrated in FIG. 4, the internal combustion engine 1 comprises a common rail 15 which receives the pressurized fuel from the high pressure fuel pump 14A and supplies the pressurized fuel to the injector 8. In this embodiment, the heating device 13 is arranged upstream of the common rail 15, so that in the common rail 15 the fuel already has the desired injection temperature T. From the common rail 15, the hot fuel (i.e. at the desired injection temperature T) is supplied to the injector 8 which injects the fraction F2 of the fuel quantity Q into the cylinder 2.

In the embodiments described above, the presence of the heating device 13 (coupled to the common rail 15) is alternative to the presence of the heating device 12 (coupled to the injector 8); i.e. or only the heating device 13 (coupled to the common rail 15) is provided or only the heating device 12 (coupled to the injector 8) is provided.

According to a different embodiment, the heating device 13 (coupled to the common rail 15) is provided together with the heating device 12 (coupled to the injector 8) and the two heating devices 12 and 13 operate in a combined and coordinated manner. In particular, the heating device 13 is always on and heats the fraction F2 of the fuel quantity Q at an intermediate temperature (for example 250° C.) which can be lower than or equal to the injection temperature T (variable and ranging between 250° C., in the case of high load and high rotation speed, and 500° C., in the case of low load and low rotation speed); instead, the heating device 12 (which is separate from and independent of the heating device 13 and is arranged downstream of the heating device 13 itself) is turned on when the intermediate temperature is lower than the injection temperature T in order to heat the fraction F2 of the fuel quantity Q from the intermediate temperature to the injection temperature T. In other words, the heating of the fraction F2 of the fuel quantity Q at the injection temperature T is divided into two distinct steps which are carried out in different places and at different times by the heating device (always turned on) and by the heating device 12 (turned on when necessary), respectively.

According to a possible embodiment, the intermediate temperature (result of the action of the heating device 13) is always constant and is equal to the minimum value that can be assumed by the injection temperature T (for example 250° C.); as a consequence, the heating device 12 is turned off when the injection temperature T assumes the minimum value (equal to the intermediate temperature). According to an alternative embodiment, the intermediate temperature is variable over time with a variation speed over time lower than a variation speed over time of the injection temperature T; in other words, the injection temperature T varies faster to follow the variation of the operating point of the engine while the intermediate temperature varies more slowly (for example, with a dynamic which is 1:5 or 1:10 of the dynamics of the injection temperature T) to follow only the long-term trend of the injection temperature T.

As previously stated, the heating device 13 is coupled to the common rail 15 (alternatively it could be arranged upstream of the common rail 15) whereas the heating device 12 is arranged downstream of the common rail 15.

As will be better explained in the following, the heating device can be arranged between the common rail 15 and the fuel injector 8 (i.e. upstream of the fuel injector 8) or the heating device 12 can be coupled to the fuel injector 8.

The combined use of both heating devices 12 and 13 allows to adjust (modify, varying) effectively (i.e. quickly) and efficiently (i.e. with minimum energy expenditure) the injection temperature T to follow the variation of the operating point of internal combustion engine 1. This result is obtained by virtue of using the heating device 13 which is arranged upstream to constantly heat a greater fuel quantity up to the intermediate temperature and to use the heating device 12 which is arranged downstream to heat, from time to time when, and as needed, up to injection temperature T, only the fraction F2 of the fuel quantity Q that must be injected shortly.

The fuel fraction F2 could be heated further with the heating device 12 arranged directly on the fuel injector 8, as will be better described in the following.

Furthermore, in this embodiment, the internal combustion engine 1 can comprise a further common rail 16 in which the fuel is at a substantially "environment" temperature (i.e. it is not heated by an active heating device). If the common rail 16, as illustrated in FIG. 4, must supply the injector 9, which performs an indirect injection, then the fuel pressure inside the common rail 16 is low. In this case the common rail 16 receives the fuel upstream of the high pressure fuel pump 14A and downstream of a low pressure fuel pump 14B. Whereas, according to a different embodiment not illustrated, if the common rail 16 must supply the injector 11 which performs direct injection, then the fuel pressure inside the common rail 16 is high. In this case, the common rail 16 receives the fuel downstream of the high pressure fuel pump 14A and upstream of the heating device 13.

In order to simplify the supplying system, a single high pressure fuel pump 14A can be used, the injection carried out by the fuel injector 9 could however be injected at a pressure equivalent to the fuel injector 8, thus deferring the two injections only for the injection temperature of the injected fuel.

In the case wherein the fraction F1 of the fuel quantity Q were to be injected directly into the combustion chamber C by the fuel injector 11, both the fraction F1 of the fuel quantity Q and the fraction F2 of the fuel quantity Q would be supplied by the same high pressure fuel pump 14A. The supplying system could also comprise two high pressure fuel pumps 14A (one for the fraction F1 of the fuel quantity Q and one for the fraction F2 of the fuel quantity Q), but this solution is not necessary and is surely costlier.

As illustrated in FIG. 4, the internal combustion engine 1 is also provided with the exhaust gas recirculation system EGR. In this case, the internal combustion engine 1 will operate with a globally lean combustion and the excess air will be partly replaced by the cooled exhaust gases. The replacement of air with suitably cooled exhaust gas contributes to decrease the maximum combustion temperature which, together with the lower percentage of oxygen in the mixture, reduces the production of $NO_X$.

The exhaust gas recirculation system EGR comprises a dedicated cooler. The exhaust gas recirculation system EGR also comprises an EGR rail and an EGR valve. By exchanging heat with the exhaust gases flowing through the exhaust gas recirculation EGR rail it is possible to heat the fuel drawn from the tank S. The fraction F1 of the fuel quantity Q is supplied through the common rail 16 arranged along the supplying duct to the injector 9 without being subjected to any type of heating. Whereas, the fraction F2 of the fuel quantity Q is heated by the heating device 13, then is supplied to the common rail 15 and finally is injected, pressurized, into the cylinder 2 by means of the injector 8. In particular, the heating device 13 is provided with a heat exchanger 13A and with an electric heating device 13B. The heat exchanger 13A uses part of the heat of the exhaust gases flowing through the EGR rail, by which the fraction F2 of the fuel quantity Q is heated. The electric heating device 13B (which can be for example of the induction type) is instead configured to perform an additional heating of the fraction F2 of the fuel quantity Q. In other words, the electric heating device 13B is configured to compensate for the heating of the fraction F2 of the fuel quantity Q, in the event that the exchanger 13A is not provided or does not sufficiently heat the fraction F2 of the fuel quantity Q. Therefore, in cases where the heat exchanged with the exhaust gases inside the heat exchanger 13A is not sufficient to heat the fraction F2 of the fuel quantity Q at the injection temperature T, the electric heating device 13B is actuated and will provide to heat the fraction F2 of the fuel quantity Q, so as to bring it to the pre-set injection temperature T.

Advantageously, the heat exchanger 13A, the electric heating device 13B and the common rail 15 can be integrated into a single heated pressurized flute.

For a better control of the temperature reached in the common rail 15 and to reduce the supply of electrical energy provided by the electric heating device 13B, it is possible to install an additional EGR valve, not illustrated, downstream of the heat exchanger 13A, which recirculates part of the exhaust gases downstream or upstream of the turbine in the supercharged internal combustion engines 1. In this way it is possible to make the heating inside the heat exchanger 13A independent of the recirculation percentage of the exhaust gases directly sucked in by the engine.

However, the exhaust gas recirculation system EGR will have its own independent cooling system so as to ensure that the internal combustion engine 1 sucks in air at the correct temperature.

According to a further and different embodiment, not illustrated, which provides for the supercharging of the internal combustion engine 1, the exhaust gas recirculation system EGR can be at low or high pressure. In low pressure exhaust gas recirculation systems EGR, the ignition of combustion gases takes place downstream of the turbine, whereas in the high pressure exhaust gas recirculation systems EGR, the ignition of the combusted gases takes place upstream of the turbine. In particular, in low pressure exhaust gas recirculation systems EGR, before supplying the exhaust gases upstream of the compressor, they must be suitably cooled.

According to a possible embodiment, it is possible to provide forms of heat exchange between the exhaust gases downstream of the turbine and the fuel before the common rail 15, and in any case downstream of the high pressure fuel pump 14A, in order to increase the fuel heating efficiency.

As the load of the internal combustion engine 1 varies, the recirculation percentage of the exhaust gases may vary. In particular, the exhaust gas recirculation percentage is typically less than 50%. Lower values of the recirculation percentage of the exhaust gas allow to have higher yields, but to meet the emission limits of the polluting gases, higher values of the recirculation percentage of the exhaust gases can be used above all to reduce the combustion temperature and therefore the formation of $NO_X$.

It is difficult to establish in absolute value the recirculation percentage values of the exhaust gases at the various engine load conditions as they are directly related to the amount of polluting emissions allowed, to the type of cycle considered and the geometrical and functional characteristics of the internal combustion engine 1. This aspect does not change the proposed concept in any way as the electronic control unit ECU will define the value optimized on the basis of theoretical-experimental maps previously determined and based on the type of emission legislation adopted.

In FIG. 5 a fuel injector 8 is illustrated. The fuel injector 8 is provided with a symmetry axis X and comprises a main body 17 in which an actuator 18 is housed, which moves a pin 19 and a nozzle 20 in which the end part of the pin 19 is housed. The fuel injector 8 comprises, furthermore, an injection valve 21 controlled by the movement of the pin 19 and the heating device 12. In particular, the heating device 12 is arranged at the nozzle 20 of the fuel injector 8 and is adapted to heat the fuel to be injected.

According to a possible embodiment, the heating device 12 heats the nozzle 20 of the fuel injector 8 which in turn heats, by conduction, the fuel flowing through the nozzle 20 itself. In this case, the heating device 12 could comprise thermo-resistances which generate heat, by Joule effect, near the nozzle 20 of the fuel injector 8; alternatively, the heating device 12 could comprise an inductor that heats the nozzle 20 of the fuel injector 8 by induction. In this embodiment, the heating device 12 is obliged to heat all the fuel flowing through the fuel injector 8 during an engine cycle, since the thermal inertias do not allow to heat only a part of the fuel flowing through the fuel injector 8.

According to a different embodiment, the heating device 12 of the fuel injector 8 generates electromagnetic waves which interact with the fuel flowing through the nozzle 20 of the fuel injector 8 to heat (directly) the fuel itself. In particular, the heating device 12 can comprise an electromagnetic induction heating device (which generates a time-varying electromagnetic field and propagates in the form of electromagnetic waves) or the heating device 12 can comprise a micro-wave heating device which generates electromagnetic waves that heat the fuel. Also in this embodiment, the heating device 12 can hardly heat only a part of the fuel flowing through the fuel injector 8 during an engine cycle, but it can vary the fuel injection temperature T with extremely rapid timings in consecutive engine cycles.

This allows to adapt the injection temperature T to the optimal conditions with much faster timing as the load conditions and the revolutions per minute of the internal combustion engine 1 are varying.

In FIG. 5, the heating device 12 is illustrated as applied externally to the nozzle 20 of the fuel injector 8; however, the heating device 12 could also be integrated (embedded) into the nozzle 20 of the fuel injector 8.

According to a different embodiment, not illustrated, the heating device 12 is arranged near the fuel injector 8. In other words, in this embodiment the heating device 12 is not applied externally to the nozzle 20 of the fuel injector 8, but is arranged near the fuel injector 8. This solution would allow the heating device 12 to be shared with several fuel injectors 8 of the same head of the internal combustion engine 1.

Figure 6:
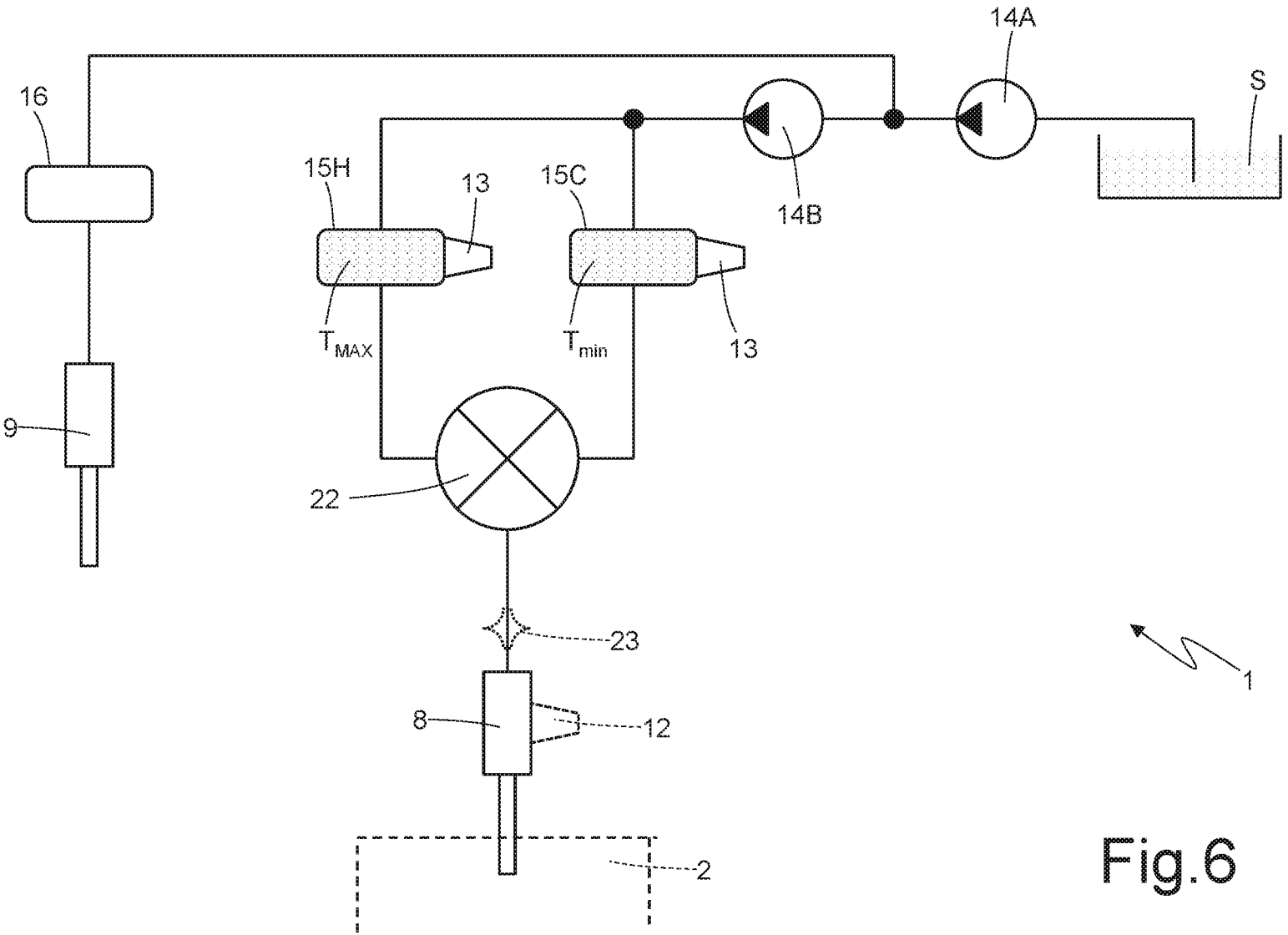
FIGS. 6 and 7 are schematic views of two further embodiments of a fuel supplying system in the internal combustion engine of FIGS. 1-4.

According to the embodiment illustrated in FIG. 6, the supplying system which supplies the heated fuel (thus supplying the fraction F2 of the fuel quantity Q) comprises: a common rail 15H adapted to contain the fuel; a heating device 13 for heating the fuel inside the common rail 15H at the maximum injection temperature $T_{MAX}$; a common rail 15C that is adapted to contain the fuel and separated from the common rail 15H; and a further heating device 13 which is coupled to the common rail 15C and is adapted to heat the fuel found inside the common rail 15C to the minimum injection temperature $T_{min}$.

In addition, the supplying system that supplies the heated fuel (thus supplying the fraction F2 of the fuel quantity Q) comprises a hydraulic mixer 22 which at input is connected to both common rails 15H and 15C, at output is connected to the fuel injector 8 (which injects the fraction F2 of the fuel quantity Q), and is adapted to supply fuel to a mixture to the fuel injector 8 in variable proportions between the fuels contained in the two common rails 15H and 15C so that the mixture has the desired injection temperature T. In other words, the fuel coming from the common rail 15C and having the minimum injection temperature $T_{min}$ is mixed in varying proportions with the fuel coming from the common rail 15H and having the maximum injection temperature $T_{MAX}$ so as to obtain fuel at the desired injection temperature T (generally intermediate between the minimum injection temperature $T_{min}$ and the maximum injection temperature $T_{MAX}$) to be supplied to the fuel injector 8.

The hydraulic mixer 22 is electronically controllable to vary the proportions of the mixture, or to vary in a complementary way the fuel quantity coming from the common rail 15C and having the minimum injection temperature $T_{min}$ and the fuel quantity coming from the common rail 15H and having the maximum injection temperature $T_{MAX}$. Preferably, the mixture produced by the hydraulic mixer 22 can comprise from 0% to 100% of the fuel coming from the common rail 15H and having the maximum injection temperature $T_{MAX}$ and therefore from 100% to 0% of the fuel coming from the second common rail 15C and having the minimum injection temperature $T_{min}$.

According to a possible embodiment illustrated in FIG. 6, the heating device 12 can be provided, which is arranged downstream of the hydraulic mixer 22 and is adapted to further heat the fuel supplied by the fuel injector 8; the function of the heating device 12 is to further heat the fuel flowing through the fuel injector 8 when the hydraulic mixer 22 fails (immediately) to supply fuel at the desired injection temperature T, to the hydraulic injector 8, due to the inevitable thermal inertias and/or due to control errors. Obviously, the heating device 12 is activated only when the actual injection temperature T is lower than the desired injection temperature T.

According to a possible embodiment illustrated in FIG. 6, a temperature sensor 23 can be provided which is adapted to detect the actual injection temperature T and then control the hydraulic mixer 22 and/or the heating device 12 to try to reset the control error that exists between the actual injection temperature T and the desired injection temperature T. The temperature sensor 23 can be arranged between the fuel injector 8 and the hydraulic mixer 22, can be integrated in the hydraulic mixer 22, or can be integrated in the fuel injector 8.

As previously described, the fraction F1 of the fuel quantity Q can be injected by the fuel injector 9 (which performs an indirect injection and therefore receives the low pressure fuel from the low pressure fuel pump 14B) or from the fuel injector 11 (which performs a direct injection and then receives the low pressure fuel from the high pressure fuel pump 14A so as to inject fuel into the cylinder 2 at the same injection pressure as the fraction F1 of the fuel quantity Q).

The heating devices 13 coupled to the two common rails 15H and 15C can be of various types as previously described (electrical by means of resistance thermometers, electrical by means of induction, electrical by means of microwave) also comprising the possibility of partial or total heat exchange with the re-circulated exhaust gases (or even not re-circulated).

The heating device 12 is always arranged downstream of the hydraulic mixer 22 and can be arranged between the hydraulic mixer 22 and the fuel injector 8 or can be coupled to (integrated with) the fuel injector 8.

Figure 7:
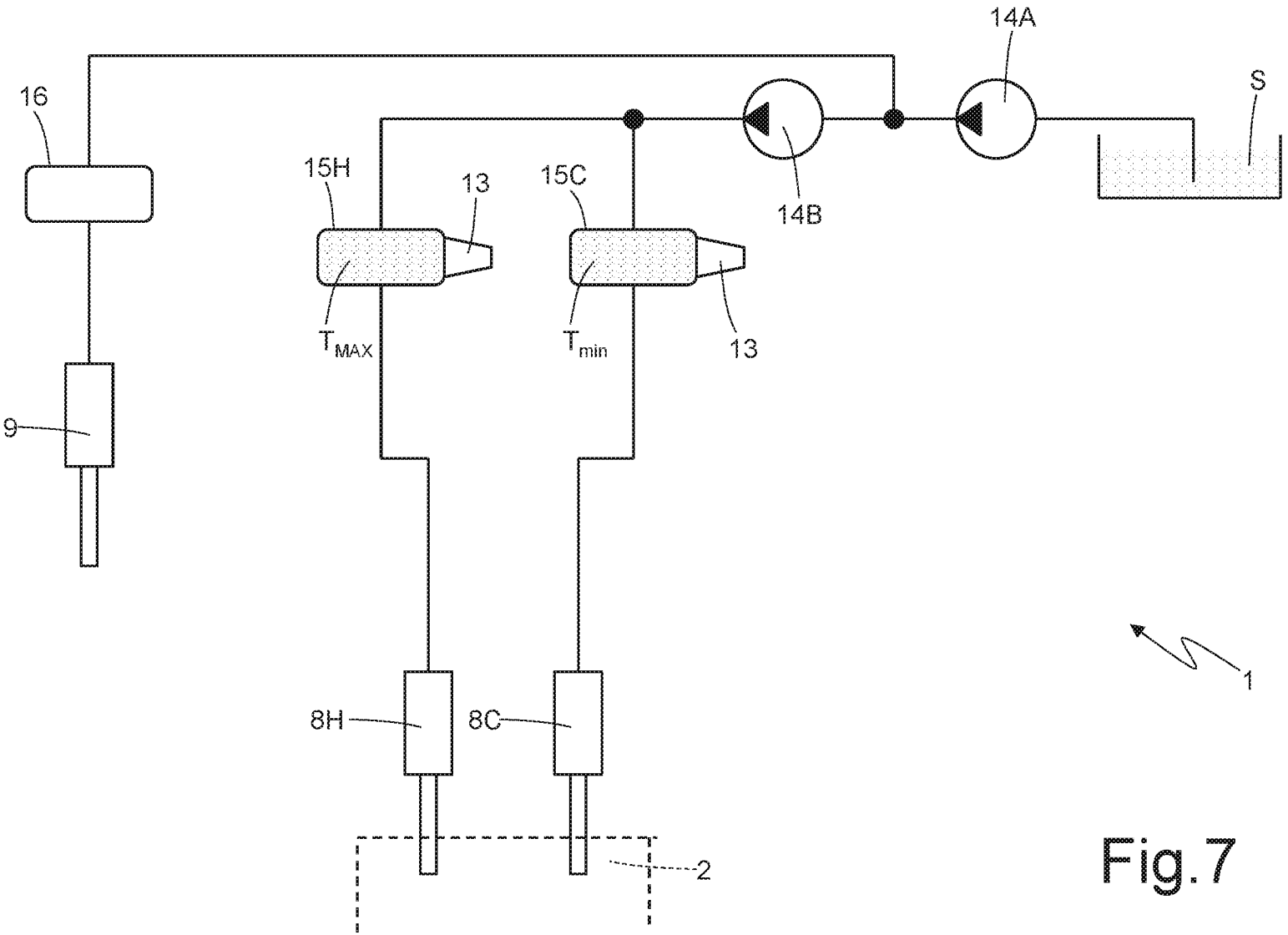

In the alternative illustrated in FIG. 7, the principle of mixing in varying proportions the fuel coming from the common rail 15C and having the minimum injection temperature $T_{min}$ with the fuel coming from the common rail 15H and having the maximum injection temperature $T_{MAX}$ to obtain fuel at the desired injection temperature T (generally intermediate between the minimum injection temperature $T_{min}$ and the maximum injection temperature $T_{MAX}$) remains completely unaffected; however, instead of making the mixture upstream of the fuel injector 8 (i.e. in the hydraulic mixer 22), the mixture is made directly inside the cylinder 2 by using a fuel injector 8H which directly injects into the cylinder 2 and receives the fuel only from the common rail 15H and a further fuel injector 8C which is independent of the fuel injector 8H, directly injects into the cylinder 2, and receives fuel only from the common rail 15C. In other words, the two fuel injector 8H and 8C are conveniently controlled to inject into the cylinder 2 the desired proportions between the fuel coming from the common rail 15C and having the minimum injection temperature $T_{min}$ and the fuel coming from the common rail 15H and having the maximum injection temperature $T_{MAX}$ so as to supply the cylinder 2 with the fraction F2 of the fuel quantity Q at the desired injection temperature T.

According to a possible embodiment, the two fuel injectors 8H and 8C are activated simultaneously (i.e. there is a time interval in which both fuel injectors 8H and 8C are active at the same moment to inject into the cylinder, at the same time, both the fuel coming from the common rail 15C and having the minimum injection temperature $T_{min}$, and the fuel coming from the common rail 15H and having the maximum injection temperature $T_{MAX}$); this embodiment makes it possible to obtain a better mixing of the fuel into the cylinder 2. According to a different embodiment, the two fuel injectors 8H and 8C are not activated at the same time (i.e. there is no time interval in which both fuel injectors 8H and 8C are active at the same time to inject into the cylinder, at the same time, both the fuel coming from the common rail 15C and having the minimum injection temperature $T_{min}$, and the fuel coming from the common rail 15H and having the maximum injection temperature $T_{MAX}$); this embodiment causes a worse mixing of the fuel inside the cylinder 2 (i.e. the load tends to stratify rather than to mix). Obviously, both possibilities can co-exist, i.e. it is possible to simultaneously activate the two fuel injectors 8H and 8C at given operating points of the internal combustion engine 1 and to not simultaneously activate the two fuel injectors 8H and 8C at other operating points of the internal combustion engine 1.

It is important to note that the presence of the hydraulic mixer arranged upstream of the cylinder 2 allows to obtain an optimal (i.e. homogeneous and complete) mixing between the fuel coming from the common rail 15C and having the minimum injection temperature $T_{min}$ and the fuel coming from the common rail 15H and having the maximum injection temperature $T_{MAX}$. On the contrary, the use of the two fuel injectors 8H and 8C allows to obtain a worse (i.e. less complete and homogeneous) mixing between the fuel coming from the common rail 15C and having the minimum injection temperature $T_{min}$ and the fuel coming from the common rail 15H and having the maximum injection temperature $T_{MAX}$; in other words, the use of the two fuel injectors 8H and 8C tends to stratify the fuel inside the cylinder 2 rather than mixing the fuel inside the cylinder 2.

The mixing of the fuel on the inside of the cylinder 2, i.e. in the combustion chamber, constitutes a further possibility of stratifying the reaction in the combustion chamber and a refined control the pressure gradient which develops during the combustion.

According to a further embodiment, to reduce emissions, the internal combustion engine 1 can be provided with compression ratio variation systems in order to increase the low-load and high-load efficiency of the internal combustion engine 1, so to reduce the fraction F2 of the hot fuel quantity Q to be injected or to allow a higher recirculation percentage of the exhaust gases at the same conditions of combustion stability. The compression ratio variation systems can comprise, for example, stroke variation systems which, by appropriate delays and/or anticipations in the closing of the intake valve 4, possibly connected to variations in the lifting profile, produce different actual compression ratios.

Various simulations and optimizations were performed using the boundary conditions of an existing geometry of a "Turbo-Diesel" type internal combustion engine supplied with gasoline. Despite the application to a geometry not optimized for the specific engine control, the results obtained were very promising and with an efficiency indicated close to 48% (running on gasoline). Therefore it can be said that the proposed method to control the combustion can work with conventional "Diesel" technology by replacing the "Diesel" injector with a fuel injector 8 to inject the fraction F2 of the fuel quantity Q and adding a low-pressure injector 9in the intake duct 10. The combustion stability and the extension of the load conditions for the optimization of performance and efficiency was more extensive than any previously control system known to date.

To obtain a further increase in efficiency the combustion chamber C requires an appropriate redesign together with a new selection regarding the materials used, to reduce the heat exchange during the combustion.

In the presence of a system for the elimination of $NO_x$ the efficiency of the internal combustion engine 1 can be optimized so as to avoid the use of the exhaust gas recirculation system EGR. Alternatively, if the exhaust gas recirculation system EGR (which is notoriously added to reduce $NO_x$ formation) is present, the possibility of avoiding any exhaust gas after-treatment system is obtained.

Further technical studies and scientific tests based on geometries of existing internal combustion engine 1 (and therefore not optimized) and supplied with gasoline have highlighted configurations that are listed in the following by way of example. As previously stated at high load of the internal combustion engine 1, excellent results have been found by placing: the angular distance from the top dead centre PMS of the beginning of the injection of the fraction F2 of the fuel quantity Q equal to 30°, the fraction F2 of the fuel quantity Q equal to 10%, the fraction of EGR equal to 0%, the injection temperature T equal to 300° C. and the injection pressure equal to 350 bar. This allowed the internal combustion engine 1 to have the indicated efficiency of 47% (running on gasoline). By means of an appropriate configuration of the piston 7, of the lubrication system, of the cooling system and with the addition of selected materials to reduce the heat exchanges between the combustion chamber C and the fluids (in particular the cooling fluids and/or the lubrication fluids) can be estimated to reach indicated efficiencies of the order of 55% (running with gasoline), a value higher than what is present in the market today comprising also the latest developments in the combustion-ignition internal combustion engines 1 for heavy commercial vehicles.

By appropriately adding the exhaust gas recirculation it is possible to bring the emission level to values such as to consider excluding the exhaust gas treatment system.

Alternatively, very high thermal efficiencies can be achieved by using conventional exhaust gas after-treatment system, while at the same time complying with international regulations on pollutant gas emissions that are based on more realistic driving cycles.

The recirculation percentage of the exhaust gases is lower than that required by compression ignition internal combustion engines 1 and therefore does not entail significant changes in efficiency, only marginally altering the specific power.

At medium load of the internal combustion engine 1, excellent results were obtained by placing: the angular distance from the top dead centre PMS of the beginning of the injection of the fraction F2 of the fuel quantity Q equal to 60°, the fraction F1 of the fuel quantity Q equal to 95%, the EGR fraction equal to 20% and the injection pressure ranging between 350-500 bar. In this case, by increasing the injection temperature T up to 500° C., the efficiency of the internal combustion engine is maximized.

Also in this case with defined geometry the indicated efficiency of 48% (working with gasoline) has been achieved. Similarly to what has been previously expressed, by means of an appropriate configuration of the combustion chamber C, the indicated efficiency value can be increased up to 55% (running on gasoline) with polluting gas emissions that do not require any exhaust gas after-treatment.

At low load of the internal combustion engine 1, excellent results were found by placing: the fraction F2 of the fuel quantity Q equal to 100% (i.e. effectively cancelling the fraction F1 of the fuel quantity Q) and by increasing the injection temperature T to 500° C. From detailed analysis of the combustion system it has also emerged that, for example, by increasing the intake air temperature at input, the fraction F2 of the fuel quantity Q equal to about 100% to 50% can be reduced. By injecting the fraction F1 of the fuel quantity Q by means of the injector 11, an appropriate stratification of the fuel concentration before the injection of the fraction F2 of the fuel quantity Q is obtained, with consequent improvement in terms of efficiency and combustion stability. In this way the fraction F2 of the fuel quantity Q can be reduced to values lower than 50% without significantly altering the efficiency of the internal combustion engine 1.

A possible embodiment of the internal combustion engine 1 (for example made according to FIG. 2) can provide for indirect injection into the intake duct 10 (low pressure range between 5 and 10 bar) of the fraction F1 of the fuel quantity Q that comprises about 90-95% at medium and high load and direct injection of the fraction F2 of the fuel quantity Q typically heated to 350° C., in any case ranging between 150° C. and 500° C. (at a maximum pressure of 500 bar) with a single 60° injection before the top dead centre PMS. It is possible to use the exhaust gas recirculation to reduce $NO_x$ especially in the absence of exhaust gas after-treatment. In this case the combustion control strategy can be carried out mainly by means of the variation of the engine angle at the beginning of injection of the fraction F2 of the fuel quantity Q and by means of the variation of the percentage of the fraction F1 of the fuel quantity Q injected into the intake duct 10.

Alternatively, the injection of the fraction F1 of the fuel quantity Q can be carried out in part by direct injection into combustion chamber C (through the fuel injector 11 centrally or laterally arranged in the combustion chamber C) which could use the same fuel pump 14A of the fuel injector 8, but which is devoid of the heating device 12. In this case, the injection of the fraction F1 of the fuel quantity Q would start during the intake stroke by means of the injector 9 and would end after the closing of the intake valve 4 by means of the injector 11 at no more than 60° from the top dead centre PMS. In this case, the combustion control can be carried out by varying the beginning of the combustion and the percentage of the fraction F2 of the fuel quantity Q with respect to the fraction F1 of the fuel quantity Q. A more complex control approach, to further improve combustion control, could be based on controlling the temperature of the air at input and the actual compression ratio by means of the actuation system of the valves 4 and 6.

To summarize what has been described above, it is clear that the injection temperature T and/or the ratio between the second fraction F2 of the fuel quantity Q and the first fraction F1 of the fuel quantity Q are varied as the load and/or the rotation speed of the internal combustion engine 1 (the combination of the load and/or of the rotation speed of the internal combustion engine 1 constitutes the engine point of the internal combustion engine 1, i.e. it represents the operating state in which the internal combustion engine 1 is at work) are varied. Obviously, the variation of the injection temperature T has longer execution times due to the inevitable thermal inertia and is therefore controlled by a slower control logic which tends to follow the average engine point (and the variation tendency of the average engine point) rather than the instantaneous engine point; instead, the variation of the ratio between the second fraction F2 of the fuel quantity Q and the first fraction F1 of the fuel quantity Q can be carried out at each cycle and is therefore controlled by a faster control logic which can follow both the average engine point (and the variation tendency of the average engine point), and the instantaneous engine point.

The method to control the combustion of a compression ignition internal combustion engine 1 with reactivity control by means of the fuel injection temperature T described above has a number of advantages. In particular, it allows the use of high compression ratios in internal combustion engines fuelled by gasoline (or other similar fuels), without incurring in undesired detonation phenomena; therefore, consequently an increase in efficiency (which is greater than 45%) of the internal combustion engine 1.

Furthermore, even the emissions of polluting gases produced by the internal combustion engine 1 described above are particularly reduced. The reduction of particulate emissions is due to a low stratification level of the mixture (due to the fraction F2 of the fuel quantity Q subsequently injected); while, the reduction of $NO_x$ emissions is obtained thanks to the fact that the combustion temperature is low (due to the homogeneity of the fraction F1 of the fuel quantity Q initially injected and the conditions of high dilution of the charge). In fact, the low temperature combustion has reduced thermal exchanges with the walls of the combustion chamber C and therefore has high thermal yields. The average ratio of the air-fuel mixtures will be much higher than the stoichiometric ratio. The lean mixture (i.e. low in fuel) guarantees low maximum temperature values in combustion chamber C during combustion, with a consequent reduced $NO_x$ formation. This allows, if desired, to avoid an after-treatment of exhaust gases or to simplify the system to the advantage of costs.

The stratification of the fuel in the cylinder 2, in terms of reactivity, leads to an acceptable pressure gradient. Therefore, the high reactivity of the fuel injected and the high injection temperature T of the fraction F2 of the fuel quantity Q, allows a safe determination of the charge self-ignition delay. The reactivity is based on the revolutions per minute and on the load condition of the internal combustion engine 1. Therefore the stratification of the charge has several advantages with respect to known internal combustion engines, in which the charge is homogeneous.

Ultimately, by way of the proposed combustion control system it is possible to decouple the method to reach the concentration stratification (obtained by means of injection of the fraction F1 of the fuel quantity Q) and the reactivity stratification (obtained by means of the injection of fraction F2 of the fuel quantity Q).

In the presence of an exhaust gas recirculation system EGR, in order to reduce $NO_x$ emissions, a preliminary mixing of the intake air with the exhaust gases (possibly cooled) could be envisaged with the aim of reducing the combustion temperature under both partial load and full load conditions.

In the event of supercharging, said supply could take place in the intake plenum (high pressure in-take and upstream of the turbine) or before the compressor (low pressure in-take downstream of the turbine).

The advantage of being able to use a less expensive gasoline, with a low octane number and with a limited or no additive quantity, which would allow to use a lower injection temperature T value.

A further advantage is that, unlike compression ignition internal combustion engines (that is, GCI engines), the proposed control method can also be applied using high octane commercial gasoline. Therefore, it is not necessary to use particular low octane fuels (for example equal to 70) which are currently not available on the market and which are necessary for compression ignition internal combustion engines (that is, GCI engines) that also use injection pressures above 1000 bar. This would also make it possible to simplify or eventually eliminate the exhaust gas after-treatment system.

By means of the injection fractioning of the present invention a single fuel (e.g. gasoline) is used and therefore a single fuel supply and storage system.

Finally, the fuel supply pressure in the cylinder 2 (by means of the fuel injector 8) is relatively low (below 500 bar).

The internal combustion engine 1 described above uses gasoline as fuel; obviously, the internal combustion engine 1 described above could use another type of gasoline-like fuel (i.e. with a low cetane number at environment temperature) instead of gasoline. For example, thanks to the use of the high injection temperature T, the use of bio-components in gasoline for compression ignition engines is made simpler, since the bio-components tend to increase the octane number and therefore the self-ignition resistance. For example, the fuel could comprise a mixture of ethanol, such as E85 (i.e. a fuel comprising 85% ethanol and the remaining 15% of fossil fuels, such as gasoline) which is provided with an octane number equal to 105 (i.e. greater than the gasoline) or E95 (i.e. a fuel comprising 95% ethanol and the remaining 5% of additives) or could comprise diesel fuels with a percentage of bio-components (such as for example ED95 or B30).

The injection fractioning which uses ethanol mixtures as fuel also allows to increase the efficiency of the internal combustion engine 1, thus further increasing the compression ratio.

The proposed combustion control system also has the advantage with respect to known systems (in which the energy to heat the complete injected fuel quantity Q can represent a significant percentage of the fuel energy, for example higher than 15% for temperatures higher than 350° C.), that only a small percentage of the injected fuel is heated, typically less than 15%. This leads to an energy contribution of less than 2% of the fuel energy content. In other words, the energy required to heat the medium and high load fuel of the internal combustion engine 1 is less than 2% of the fuel energy injected. Therefore, the percentage of fuel to be heated can easily be heated with a simple heating system and possibly by heat exchange with the exhaust gases.

The use of a single type of fuel for both injections simplifies the layout of the internal combustion engine 1, not having the redundancy of separate tanks, separate pumps, etc. In addition, a low pressure injection system (typically less than 500 bar) can be used.

Advantageously, the possibility of varying reactivity allows to make combustion control simpler with respect to known homogeneous (i.e. without stratification) internal combustion engines, presenting an advantage in terms of similar thermal efficiency. Therefore, the reactivity stratification, decreases the pressure gradient in self-ignition conditions and therefore allows different parts of the charge to be affected in a gradual manner in the combustion chamber C.

Furthermore, the variation of the injection temperature T and/or of the ratio between the fraction F2 and the fraction F1 of the fuel quantity Q and/or of the angular distance from the top dead centre PMS of the beginning of the injection of the fraction F2 of the fuel quantity Q as the load and/or rotation speed of the internal combustion engine 1 varies, it allows to optimize the combustion inside the combustion chamber C at the various engine loads, thus presenting a functioning range much higher than what has been proposed to date.

The method to control the combustion of the compression ignition internal combustion engine 1 with reactivity control by means of the injection temperature also exhibits an improved control of the low temperature combustion. Therefore, it is possible to significantly reduce exhaust emissions, in order to significantly reduce (or even eliminate) exhaust gas after-treatment systems.

Another advantage is that the combustion control system previously described finds advantageous application in any type of internal combustion engine 1. In particular, in automotive engines, but also in engines for light and heavy commercial vehicles.

The internal combustion engine 1 made according to the present invention also does not require high charge swirling motions inside the combustion chamber C, similar to the spontaneous ignition charge internal combustion engines 1 of the latest generation. In fact, according to the invention, the injection takes place with a poor but already carburized mixture and therefore macro-vorticity is not necessary (that is, the swirl and tumble motions in the cylinder 2) which normally help combustion by diffusion in the spontaneous ignition charge internal combustion engines 1. This leads to a further reduction of pumping losses during the supply of the internal combustion engine 1 by means of a more efficient design of the intake ducts 10 and reduces the losses due to heat exchange during combustion, thus obtaining an improvement in the combustion efficiency.

Finally, even if not strictly necessary for the implementation of the described invention, the system could also work at higher injection pressures, it could use two different fuels and could benefit from more expensive technologies. Furthermore, it could work with more than two levels of injection temperature T and at the beginning the injection temperature T can vary continuously. All of these aspects can be included in the present invention, but they are not strictly necessary to obtain a higher efficiency with respect to the current state of the art in terms of advanced combustion systems.

The invention claimed is:

1. A method to control in any possible operating point the combustion of a compression ignition internal combustion engine (1); the internal combustion engine (1) is provided with at least one piston (7), which slides, with a reciprocating motion, on the inside of a cylinder (2), so as to carry out a succession of combustion cycles, each comprising at least an intake stroke and a compression stroke; the control method comprises the steps of:

determining the operating point constituted by a load and by a rotation speed of the internal combustion engine (1);

establishing, for each combustion cycle, a fuel quantity (Q) to be injected into the cylinder (2);

injecting a first fraction of the fuel quantity (Q) at least partially during the intake and/or compression stroke by means of a first fuel injector (9; 11), which receives the fuel from a first supplying system without active heating devices, so that the first fraction (F1) of the fuel quantity (Q) has a temperature that is lower than an injection temperature (T) higher than 100° C.;

heating a second fraction (F2) of the fuel quantity (Q), which is equal to the remaining fraction of the fuel quantity (Q), at the injection temperature (T);

injecting the second fraction (F2) of the fuel quantity (Q) heated at the injection temperature (T) into the cylinder (2) at the end of the compression stroke and at no more than 60° from the top dead centre (PMS) by means of a second fuel injector (8), which is different from and independent of the first fuel injector (9; 11), directly injects into the cylinder (2), and receives the fuel from a second supplying system, which is at least partially separate from and independent of the first supplying system and is provided with at least one active heating device (12; 13), which is controlled so as to cause the fuel to have the injection temperature (T);

reducing the injection temperature (T) when the load increases and/or when the rotation speed of the internal combustion engine (1) increases;

taking place the change of the injection temperature (T) by means of a control system in a closed loop, which carries out the change of the injection temperature (T) based on an input variable, taking into account at least one operation variable of the internal combustion engine (1), and using a feedback variable;

choosing the input variable between: the load of the internal combustion engine (1) and the rotation speed of the internal combustion engine (1);

choosing the operation variable of the internal combustion engine (1) between: the temperature of the air at the inlet of the internal combustion engine (1), the temperature of the cooling fluid of the internal combustion engine (1), the temperature of the lubrication oil of the internal combustion engine (1), the temperature of the exhaust gases, the revolutions per minute of the internal combustion engine (1), the temperature of the exhaust gases for the recirculation, the pressure in the plenum of the intake manifold (3), the pressure upstream of the turbine, the revolutions per minute of the turbocharger, the temperature of the exhaust gases upstream of the turbine, the fuel temperature in the common rail (15), the position of the timing variation devices and/or of a variable lift system, the position of the regulators of the turbocharger in case of variable geometry of the compressor and of the turbine; and choosing the feedback variable between: the maximum combustion pressure, the angular position corresponding to a percentage, in particular 50%, of the quantity (Q) of burnt fuel, the pressure gradient during the combustion of the fuel in the combustion chamber (C).

2. The method to control an internal combustion engine (1) according to claim 1 and comprising the further step of reducing the ratio between the second fraction (F2) of the fuel quantity (Q) and the first fraction (F1) of the fuel quantity (Q) when the load increases and when the rotation speed of the internal combustion engine (1) increases.

3. The method to control an internal combustion engine (1) according to claim 1, wherein, when the internal combustion engine (1) works with a low load, in particular when the indicated mean pressure is below 4 bar, and when the air inside the cylinder (2) at the closing of the intake valve (4) is not heated at a temperature of at least 70° C.:

the injection temperature (T) is equal to at least 500° C.; and/or the second fraction (F2) of the fuel quantity (Q) comprises at least 70% of the fuel quantity (Q) and can temporarily reach 100% of the fuel quantity (Q).

4. The method to control an internal combustion engine (1) according to claim 1, wherein, when the internal combustion engine (1) works with a low load, in particular when the indicated mean pressure is below 4 bar, it is provided the further step of heating at a temperature of at least 70° C. the air inside the cylinder (2) at the closing of the intake valve (4).

5. The method to control an internal combustion engine (1) according to claim 4, wherein, when the internal combustion engine (1) works with a low load, in particular when the indicated mean pressure is below 4 bar, and when the air inside the cylinder (2) at the closing of the intake valve (4) is heated at a temperature of at least 70° C.:

the injection temperature (T) is equal to at least 450° C.; and/or the second fraction (F2) of the fuel quantity (Q) is comprised between the 40% and the 60% of the fuel quantity (Q).

6. The method to control an internal combustion engine (1) according to claim 4, wherein, when the internal combustion engine (1) works with a low load, in particular when the indicated mean pressure is below 4 bar, when the air inside the cylinder (2) at the closing of the intake valve (4), is heated at a temperature of at least 70° C., and when at least part of the first fraction (F1) of the fuel quantity (Q) is injected directly inside the cylinder (2):

the injection temperature (T) is equal to at least 400° C.; and/or the second fraction (F2) of the fuel quantity (Q) is comprised between 30% and 50% of the fuel quantity (Q).

7. The method to control an internal combustion engine (1) according to claim 1, wherein:

when the internal combustion engine (1) works with a low load, in particular when the indicated mean pressure is below 4 bar, the exhaust gas recirculation percentage is zero;

when the internal combustion engine (1) works with a medium load, in particular when the indicated mean pressure ranges from 4 to 11 bar, the exhaust gas recirculation percentage is comprised between 0% and 25%; and when the internal combustion engine (1) works with a high load, in particular when the indicated mean pressure is higher than 11 bar, the exhaust gas recirculation percentage is comprised between 0% and 30%.

8. The method to control an internal combustion engine (1) according to claim 1, wherein when the internal combustion engine (1) works with a medium load, in particular when the indicated mean pressure ranges from 4 to 11 bar:

the injection temperature (T) is comprised between 350° C. and 500° C.; and/or the second fraction (F2) of the fuel quantity (Q) is comprised between 5% and 25% of the fuel quantity (Q).

9. The method to control an internal combustion engine (1) according to claim 1, wherein when the internal combustion engine (1) works with a high load, in particular when the indicated mean pressure is higher than 11 bar, the injection temperature (T) is comprised between 200° C. and 350° C.; and/or the second fraction (F2) of the fuel quantity (Q) is comprised between 3% and 10% of the fuel quantity (Q).

10. The method to control an internal combustion engine (1) according to claim 1, wherein when the internal combustion engine (1) works with a high load, in particular when the indicated mean pressure is higher than 11 bar, the angular distance from the top dead centre (PMS) of the beginning of the injection of the second fraction (F2) ranges from 30° to 60°.

11. The method to control an internal combustion engine (1) according to claim 1, wherein when the internal combustion engine (1) works with a high load, in particular when the indicated mean pressure is higher than 11 bar, at least part of the first fraction (F1) of the fuel quantity (Q) is injected by the first injector (11) within 60° from the top dead centre (PMS).

12. The method to control an internal combustion engine (1) according to claim 11, wherein:

a first part of the first fraction (F1) of the fuel quantity (Q) is injected by the first injector (11) within 60° prior to the top dead centre (PMS); and a second part of the first fraction (F1) of the fuel quantity (Q) is injected after the top dead centre (PMS).

13. The method to control an internal combustion engine (1) according to claim 1, wherein when the internal combustion engine (1) works with a high load, in particular when the indicated mean pressure is higher than 11 bar, the angular distance from the top dead centre (PMS) of the beginning of the injection of the second fraction (F2) is smaller than 40°.

14. The method to control an internal combustion engine (1) according to claim 1, wherein the injection of the second fraction (F2) of the fuel quantity (Q) is multiple; and the first injection is carried out at no more than 90° from the top dead centre (PMS), whereas the last injection is carried out at no more than 60° from the top dead centre (PMS).

15. The method to control an internal combustion engine (1) according to claim 1, wherein the first fraction (F1) of the fuel quantity (Q) is injected partly during the intake stroke and, for the remaining part, during the compression stroke and preferably within 60° from the top dead centre.

16. The method to control an internal combustion engine (1) according to claim 1, wherein the second supplying system comprises:

a first heating device (13), which is always on and heats the second fraction (F2) of the fuel quantity (Q) at an intermediate temperature which can be lower than or equal to the injection temperature (T); and a second heating device (12), which is separate and independent from the first heating device (13), is arranged downstream of the first heating device (13), and is turned on when the intermediate temperature is lower than the injection temperature (T) for heating the second fraction (F2) of the fuel quantity (Q) from the intermediate temperature at the injection temperature (T).

17. The method to control an internal combustion engine (1) according to claim 1, wherein the second supplying system comprises:

a first common rail (15H) for containing the fuel;

a first heating device (13) for heating the fuel inside the first common rail (15H) at a maximum injection temperature (TMAX);

a second common rail (15C) for containing the fuel and separated from the first common rail (15H); and a second heating device (13) for heating the fuel inside the second common rail (15C) at a minimum injection temperature (Tmin) lower than the maximum injection temperature (TMAX).

18. A method to control the combustion of a compression ignition internal combustion engine (1); the internal combustion engine (1) is provided with at least one piston (7), which slides, with a reciprocating motion, on the inside of a cylinder (2), so as to carry out a succession of combustion cycles, each comprising at least an intake stroke and a compression stroke; the control method comprises the steps of:

establishing, for each combustion cycle, a fuel quantity (Q) to be injected into the cylinder (2);

injecting a first fraction of the fuel quantity (Q) at least partially during the intake and/or compression stroke by means of a first fuel injector (9; 11), which receives the fuel from a first supplying system without active heating devices, so that the first fraction (F1) of the fuel quantity (Q) has a temperature that is lower than an injection temperature (T) higher than 100° C.;

heating a second fraction (F2) of the fuel quantity (Q), which is equal to the remaining fraction of the fuel quantity (Q), at the injection temperature (T);

injecting the second fraction (F2) of the fuel quantity (Q) heated at the injection temperature (T) into the cylinder (2) at the end of the compression stroke and at no more than 60° from the top dead centre (PMS) by means of a second fuel injector (8), which is different from and independent of the first fuel injector (9; 11), directly injects into the cylinder (2), and receives the fuel from a second supplying system, which is at least partially separate from and independent of the first supplying system and is provided with at least one active heating device (12; 13), which is controlled so as to cause the fuel to have the injection temperature (T); and varying the injection temperature (T) as a function of the load of the internal combustion engine (1) and/or as a function of the rotation speed of the internal combustion engine (1) between a maximum injection temperature (TMAX) and a minimum injection temperature (Tmin) lower than the maximum injection temperature (TMAX);

wherein the second supplying system comprises:

a first common rail (15H) for containing the fuel;

a first heating device (13) for heating the fuel inside the first common rail (15H) at the maximum injection temperature (TMAX);

a second common rail (15C) for containing the fuel and separated from the first common rail (15H); and a second heating device (13) for heating the fuel inside the second common rail (15C) at the minimum injection temperature (Tmin).

19. A method to control in any possible operating point the combustion of a compression ignition internal combustion engine (1); the internal combustion engine (1) is provided with at least one piston (7), which slides, with a reciprocating motion, on the inside of a cylinder (2), so as to carry out a succession of combustion cycles, each comprising at least an intake stroke and a compression stroke; the control method comprises the steps of:

determining the operating point constituted by a load and by a rotation speed of the internal combustion engine (1);

establishing, for each combustion cycle, a fuel quantity (Q) to be injected into the cylinder (2);

injecting a first fraction of the fuel quantity (Q) at least partially during the intake and/or compression stroke by means of a first fuel injector (9; 11), which receives the fuel from a first supplying system without active heating devices, so that the first fraction (F1) of the fuel quantity (Q) has a temperature that is lower than an injection temperature (T) higher than 100° C.;

heating a second fraction (F2) of the fuel quantity (Q), which is equal to the remaining fraction of the fuel quantity (Q), at the injection temperature (T);

injecting the second fraction (F2) of the fuel quantity (Q) heated at the injection temperature (T) into the cylinder (2) at the end of the compression stroke and at no more than 60° from the top dead centre (PMS) by means of a second fuel injector (8), which is different from and independent of the first fuel injector (9; 11), directly injects into the cylinder (2), and receives the fuel from a second supplying system, which is at least partially separate from and independent of the first supplying system and is provided with at least one active heating device (12; 13), which is controlled so as to cause the fuel to have the injection temperature (T); and reducing the injection temperature (T) when the load increases and/or when the rotation speed of the internal combustion engine (1) increases;

wherein, when the internal combustion engine (1) works with a low load, in particular when the indicated mean pressure is below 4 bar, and when the air inside the cylinder (2) at the closing of the intake valve (4) is not heated at a temperature of at least 70° C.: the injection temperature (T) is equal to at least 500° C.; and/or the second fraction (F2) of the fuel quantity (Q) comprises at least 70% of the fuel quantity (Q) and can temporarily reach 100% of the fuel quantity (Q).

20. A method to control in any possible operating point the combustion of a compression ignition internal combustion engine (1); the internal combustion engine (1) is provided with at least one piston (7), which slides, with a reciprocating motion, on the inside of a cylinder (2), so as to carry out a succession of combustion cycles, each comprising at least an intake stroke and a compression stroke; the control method comprises the steps of:

determining the operating point constituted by a load and by a rotation speed of the internal combustion engine (1);

establishing, for each combustion cycle, a fuel quantity (Q) to be injected into the cylinder (2);

injecting a first fraction of the fuel quantity (Q) at least partially during the intake and/or compression stroke by means of a first fuel injector (9; 11), which receives the fuel from a first supplying system without active heating devices, so that the first fraction (F1) of the fuel quantity (Q) has a temperature that is lower than an injection temperature (T) higher than 100° C.;

heating a second fraction (F2) of the fuel quantity (Q), which is equal to the remaining fraction of the fuel quantity (Q), at the injection temperature (T);

injecting the second fraction (F2) of the fuel quantity (Q) heated at the injection temperature (T) into the cylinder (2) at the end of the compression stroke and at no more than 60° from the top dead centre (PMS) by means of a second fuel injector (8), which is different from and independent of the first fuel injector (9; 11), directly injects into the cylinder (2), and receives the fuel from a second supplying system, which is at least partially separate from and independent of the first supplying system and is provided with at least one active heating device (12; 13), which is controlled so as to cause the fuel to have the injection temperature (T); and reducing the injection temperature (T) when the load increases and/or when the rotation speed of the internal combustion engine (1) increases;

wherein, when the internal combustion engine (1) works with a low load, in particular when the indicated mean pressure is below 4 bar, it is provided the further step of heating at a temperature of at least 70° C. the air inside the cylinder (2) at the closing of the intake valve (4).

21. The method to control an internal combustion engine (1) according to claim 20, wherein, when the internal combustion engine (1) works with a low load, in particular when the indicated mean pressure is below 4 bar, and when the air inside the cylinder (2) at the closing of the intake valve (4) is heated at a temperature of at least 70° C.: the injection temperature (T) is equal to at least 450° C.; and/or the second fraction (F2) of the fuel quantity (Q) is comprised between the 40% and the 60% of the fuel quantity (Q).

22. The method to control an internal combustion engine (1) according to claim 20, wherein, when the internal combustion engine (1) works with a low load, in particular when the indicated mean pressure is below 4 bar, when the air inside the cylinder (2) at the closing of the intake valve (4) is heated at a temperature of at least 70° C., and when at least part of the first fraction (F1) of the fuel quantity (Q) is injected directly inside the cylinder (2): the injection temperature (T) is equal to at least 400° C.; and/or the second fraction (F2) of the fuel quantity (Q) is comprised between 30% and 50% of the fuel quantity (Q).

23. A method to control in any possible operating point the combustion of a compression ignition internal combustion engine (1); the internal combustion engine (1) is provided with at least one piston (7), which slides, with a reciprocating motion, on the inside of a cylinder (2), so as to carry out a succession of combustion cycles, each comprising at least an intake stroke and a compression stroke; the control method comprises the steps of:

determining the operating point constituted by a load and by a rotation speed of the internal combustion engine (1);

establishing, for each combustion cycle, a fuel quantity (Q) to be injected into the cylinder (2);

injecting a first fraction of the fuel quantity (Q) at least partially during the intake and/or compression stroke by means of a first fuel injector (9; 11), which receives the fuel from a first supplying system without active heating devices, so that the first fraction (F1) of the fuel quantity (Q) has a temperature that is lower than an injection temperature (T) higher than 100° C.;

heating a second fraction (F2) of the fuel quantity (Q), which is equal to the remaining fraction of the fuel quantity (Q), at the injection temperature (T);

injecting the second fraction (F2) of the fuel quantity (Q) heated at the injection temperature (T) into the cylinder (2) at the end of the compression stroke and at no more than 60° from the top dead centre (PMS) by means of a second fuel injector (8), which is different from and independent of the first fuel injector (9; 11), directly injects into the cylinder (2), and receives the fuel from a second supplying system, which is at least partially separate from and independent of the first supplying system and is provided with at least one active heating device (12; 13), which is controlled so as to cause the fuel to have the injection temperature (T); and reducing the injection temperature (T) when the load increases and/or when the rotation speed of the internal combustion engine (1) increases;

wherein when the internal combustion engine (1) works with a medium load, in particular when the indicated mean pressure ranges from 4 to 11 bar: the injection temperature (T) is comprised between 350° C. and 500° C.; and/or the second fraction (F2) of the fuel quantity (Q) is comprised between 5% and 25% of the fuel quantity (Q).

24. A method to control in any possible operating point the combustion of a compression ignition internal combustion engine (1); the internal combustion engine (1) is provided with at least one piston (7), which slides, with a reciprocating motion, on the inside of a cylinder (2), so as to carry out a succession of combustion cycles, each comprising at least an intake stroke and a compression stroke; the control method comprises the steps of:

determining the operating point constituted by a load and by a rotation speed of the internal combustion engine (1);

establishing, for each combustion cycle, a fuel quantity (Q) to be injected into the cylinder (2);

injecting a first fraction of the fuel quantity (Q) at least partially during the intake and/or compression stroke by means of a first fuel injector (9; 11), which receives the fuel from a first supplying system without active heating devices, so that the first fraction (F1) of the fuel quantity (Q) has a temperature that is lower than an injection temperature (T) higher than 100° C.;

heating a second fraction (F2) of the fuel quantity (Q), which is equal to the remaining fraction of the fuel quantity (Q), at the injection temperature (T);

injecting the second fraction (F2) of the fuel quantity (Q) heated at the injection temperature (T) into the cylinder (2) at the end of the compression stroke and at no more than 60° from the top dead centre (PMS) by means of a second fuel injector (8), which is different from and independent of the first fuel injector (9; 11), directly injects into the cylinder (2), and receives the fuel from a second supplying system, which is at least partially separate from and independent of the first supplying system and is provided with at least one active heating device (12; 13), which is controlled so as to cause the fuel to have the injection temperature (T); and reducing the injection temperature (T) when the load increases and/or when the rotation speed of the internal combustion engine (1) increases;

wherein when the internal combustion engine (1) works with a high load, in particular when the indicated mean pressure is higher than 11 bar, the injection temperature (T) is comprised between 200° C. and 350° C.; and/or the second fraction (F2) of the fuel quantity (Q) is comprised between 3% and 10% of the fuel quantity (Q).

25. A method to control in any possible operating point the combustion of a compression ignition internal combustion engine (1); the internal combustion engine (1) is provided with at least one piston (7), which slides, with a reciprocating motion, on the inside of a cylinder (2), so as to carry out a succession of combustion cycles, each comprising at least an intake stroke and a compression stroke; the control method comprises the steps of:

determining the operating point constituted by a load and by a rotation speed of the internal combustion engine (1);

establishing, for each combustion cycle, a fuel quantity (Q) to be injected into the cylinder (2);

injecting a first fraction of the fuel quantity (Q) at least partially during the intake and/or compression stroke by means of a first fuel injector (9; 11), which receives the fuel from a first supplying system without active heating devices, so that the first fraction (F1) of the fuel quantity (Q) has a temperature that is lower than an injection temperature (T) higher than 100° C.;

heating a second fraction (F2) of the fuel quantity (Q), which is equal to the remaining fraction of the fuel quantity (Q), at the injection temperature (T);

injecting the second fraction (F2) of the fuel quantity (Q) heated at the injection temperature (T) into the cylinder (2) at the end of the compression stroke and at no more than 60° from the top dead centre (PMS) by means of a second fuel injector (8), which is different from and independent of the first fuel injector (9; 11), directly injects into the cylinder (2), and receives the fuel from a second supplying system, which is at least partially separate from and independent of the first supplying system and is provided with at least one active heating device (12; 13), which is controlled so as to cause the fuel to have the injection temperature (T); and reducing the injection temperature (T) when the load increases and/or when the rotation speed of the internal combustion engine (1) increases;

wherein when the internal combustion engine (1) works with a high load, in particular when the indicated mean pressure is higher than 11 bar, the angular distance from the top dead centre (PMS) of the beginning of the injection of the second fraction (F2) ranges from 30° to 60°.

26. The method to control in any possible operating point the combustion of a compression ignition internal combustion engine (1); the internal combustion engine (1) is provided with at least one piston (7), which slides, with a reciprocating motion, on the inside of a cylinder (2), so as to carry out a succession of combustion cycles, each comprising at least an intake stroke and a compression stroke; the control method comprises the steps of:

determining the operating point constituted by a load and by a rotation speed of the internal combustion engine (1);

establishing, for each combustion cycle, a fuel quantity (Q) to be injected into the cylinder (2);

injecting a first fraction of the fuel quantity (Q) at least partially during the intake and/or compression stroke by means of a first fuel injector (9; 11), which receives the fuel from a first supplying system without active heating devices, so that the first fraction (F1) of the fuel quantity (Q) has a temperature that is lower than an injection temperature (T) higher than 100° C.;

heating a second fraction (F2) of the fuel quantity (Q), which is equal to the remaining fraction of the fuel quantity (Q), at the injection temperature (T);

injecting the second fraction (F2) of the fuel quantity (Q) heated at the injection temperature (T) into the cylinder (2) at the end of the compression stroke and at no more than 60° from the top dead centre (PMS) by means of a second fuel injector (8), which is different from and independent of the first fuel injector (9; 11), directly injects into the cylinder (2), and receives the fuel from a second supplying system, which is at least partially separate from and independent of the first supplying system and is provided with at least one active heating device (12; 13), which is controlled so as to cause the fuel to have the injection temperature (T); and reducing the injection temperature (T) when the load increases and/or when the rotation speed of the internal combustion engine (1) increases;

wherein when the internal combustion engine (1) works with a high load, in particular when the indicated mean pressure is higher than 11 bar, at least part of the first fraction (F1) of the fuel quantity (Q) is injected by the first injector (11) within 60° from the top dead centre (PMS).

27. The method to control an internal combustion engine (1) according to claim 25, wherein:

a first part of the first fraction (F1) of the fuel quantity (Q) is injected by the first injector (11) within 60° prior to the top dead centre (PMS); and a second part of the first fraction (F1) of the fuel quantity (Q) is injected after the top dead centre (PMS).

28. The method to control in any possible operating point the combustion of a compression ignition internal combustion engine (1); the internal combustion engine (1) is provided with at least one piston (7), which slides, with a reciprocating motion, on the inside of a cylinder (2), so as to carry out a succession of combustion cycles, each comprising at least an intake stroke and a compression stroke; the control method comprises the steps of:

determining the operating point constituted by a load and by a rotation speed of the internal combustion engine (1);

establishing, for each combustion cycle, a fuel quantity (Q) to be injected into the cylinder (2);

injecting a first fraction of the fuel quantity (Q) at least partially during the intake and/or compression stroke by means of a first fuel injector (9; 11), which receives the fuel from a first supplying system without active heating devices, so that the first fraction (F1) of the fuel quantity (Q) has a temperature that is lower than an injection temperature (T) higher than 100° C.;

heating a second fraction (F2) of the fuel quantity (Q), which is equal to the remaining fraction of the fuel quantity (Q), at the injection temperature (T);

injecting the second fraction (F2) of the fuel quantity (Q) heated at the injection temperature (T) into the cylinder (2) at the end of the compression stroke and at no more than 60° from the top dead centre (PMS) by means of a second fuel injector (8), which is different from and independent of the first fuel injector (9; 11), directly injects into the cylinder (2), and receives the fuel from a second supplying system, which is at least partially separate from and independent of the first supplying system and is provided with at least one active heating device (12; 13), which is controlled so as to cause the fuel to have the injection temperature (T); and reducing the injection temperature (T) when the load increases and/or when the rotation speed of the internal combustion engine (1) increases;

wherein when the internal combustion engine (1) works with a high load, in particular when the indicated mean pressure is higher than 11 bar, the angular distance from the top dead centre (PMS) of the beginning of the injection of the second fraction (F2) is smaller than 40°.

* * * * *